US011950654B2

(12) United States Patent
Swigart et al.

(10) Patent No.: US 11,950,654 B2
(45) Date of Patent: Apr. 9, 2024

(54) FLUID-FILLED CHAMBER WITH A STACKED TENSILE MEMBER

(71) Applicant: NIKE, Inc., Beaverton, OR (US)

(72) Inventors: John F. Swigart, Portland, OR (US); Amy E. Gishifu, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/957,876

(22) Filed: Sep. 30, 2022

(65) Prior Publication Data

US 2023/0029421 A1 Jan. 26, 2023

Related U.S. Application Data

(62) Division of application No. 16/508,462, filed on Jul. 11, 2019, now Pat. No. 11,484,094, which is a division of application No. 14/855,523, filed on Sep. 16, 2015, now Pat. No. 10,383,397, which is a division of application No. 12/938,175, filed on Nov. 2, 2010, now Pat. No. 9,161,592.

(51) Int. Cl.
*A43B 13/20* (2006.01)
*A43B 13/18* (2006.01)

(52) U.S. Cl.
CPC ..... *A43B 13/20* (2013.01); *A43B 13/18* (2013.01); *A43B 13/185* (2013.01); *A43B 13/189* (2013.01)

(58) Field of Classification Search
CPC ..... A43B 13/18; A43B 13/185; A43B 13/20
USPC ..... 36/28, 29, 35 R, 35 B, 37
See application file for complete search history.

(56) References Cited

U.S. PATENT DOCUMENTS

| | | | |
|---|---|---|---|
| 3,253,355 | A | 5/1966 | Menken |
| 3,984,926 | A | 10/1976 | Calderon |
| 4,025,974 | A | 5/1977 | Lea et al. |
| 4,183,156 | A | 1/1980 | Rudy |
| 4,219,945 | A | 9/1980 | Rudy |
| 4,287,250 | A | 9/1981 | Rudy |
| 4,340,626 | A | 7/1982 | Rudy |
| 4,513,449 | A | 4/1985 | Donzis |
| 4,619,055 | A | 10/1986 | Davidson |
| 4,656,760 | A | 4/1987 | Tonkel et al. |

(Continued)

FOREIGN PATENT DOCUMENTS

| | | | |
|---|---|---|---|
| CN | 1383363 | A | 12/2002 |
| CN | 1878484 | A | 12/2006 |

(Continued)

OTHER PUBLICATIONS

International Search Report and Written Opinion in PCT Application No. PCT/US2011/058639, dated Mar. 9, 2012.

(Continued)

*Primary Examiner* — Katharine G Kane
(74) *Attorney, Agent, or Firm* — Banner & Witcoff, Ltd.

(57) ABSTRACT

A fluid-filled chamber may have a barrier, a stacked tensile member, and a fluid. The barrier may be formed from a polymer material that is sealed to define an interior void. The stacked tensile member may be located within the interior void and includes a first tensile element and a second tensile element that are joined to each other. Additionally, opposite sides of the stacked tensile member are joined to the barrier. The fluid is located within the interior void and may be pressurized to place an outward force upon the barrier and induce tension in the stacked tensile member. In some configurations, each of the tensile elements may be a spacer textile.

20 Claims, 24 Drawing Sheets

(56) References Cited

U.S. PATENT DOCUMENTS

| | | | |
|---|---|---|---|
| 4,785,558 | A | 11/1988 | Shiomura |
| 4,874,640 | A | 10/1989 | Donzis |
| 4,906,502 | A | 3/1990 | Rudy |
| 4,936,029 | A | 6/1990 | Rudy |
| 5,042,176 | A | 8/1991 | Rudy |
| 5,083,361 | A | 1/1992 | Rudy |
| 5,134,790 | A | 8/1992 | Woitschaetzke et al. |
| 5,369,896 | A | 12/1994 | Frachey et al. |
| 5,543,184 | A | 8/1996 | Barnes et al. |
| 5,543,194 | A | 8/1996 | Rudy |
| 5,572,804 | A | 11/1996 | Skaja et al. |
| 5,630,237 | A | 5/1997 | Ku |
| 5,713,141 | A | 2/1998 | Mitchell et al. |
| 5,741,568 | A | 4/1998 | Rudy |
| 5,802,739 | A | 9/1998 | Potter et al. |
| 5,918,383 | A | 7/1999 | Chee |
| 5,952,065 | A | 9/1999 | Mitchell et al. |
| 5,987,781 | A | 11/1999 | Pavesi et al. |
| 5,993,585 | A | 11/1999 | Goodwin et al. |
| 6,013,340 | A | 1/2000 | Bonk et al. |
| 6,029,962 | A | 2/2000 | Shorten et al. |
| 6,041,521 | A | 3/2000 | Wong |
| 6,082,025 | A | 7/2000 | Bonk et al. |
| 6,098,313 | A | 8/2000 | Skaja |
| 6,119,371 | A | 9/2000 | Goodwin et al. |
| 6,127,010 | A | 10/2000 | Rudy |
| 6,127,026 | A | 10/2000 | Bonk et al. |
| 6,158,149 | A | 12/2000 | Rudy |
| 6,203,868 | B1 | 3/2001 | Bonk et al. |
| 6,321,465 | B1 | 11/2001 | Bonk et al. |
| 6,385,864 | B1 | 5/2002 | Sell, Jr. et al. |
| 6,402,879 | B1 | 6/2002 | Tawney et al. |
| 6,837,951 | B2 | 1/2005 | Rapaport |
| 7,070,845 | B2 | 7/2006 | Thomas et al. |
| 7,131,218 | B2 | 11/2006 | Schindler |
| 7,210,249 | B2 | 5/2007 | Passke et al. |
| 7,409,779 | B2 | 8/2008 | Dojan et al. |
| 2002/0121031 | A1 | 9/2002 | Smith et al. |
| 2003/0097767 | A1 | 5/2003 | Perkinson |
| 2005/0039346 | A1 | 2/2005 | Thomas et al. |
| 2005/0097777 | A1 | 5/2005 | Goodwin |
| 2006/0225304 | A1 | 10/2006 | Goodwin |
| 2006/0230635 | A1 | 10/2006 | White et al. |
| 2006/0230636 | A1 | 10/2006 | Kokstis et al. |
| 2007/0169379 | A1 | 7/2007 | Hazenberg et al. |
| 2008/0110047 | A1 | 5/2008 | White et al. |
| 2009/0288312 | A1 | 11/2009 | Dua |
| 2009/0288313 | A1 | 11/2009 | Rapaport et al. |
| 2011/0131831 | A1 | 6/2011 | Peyton et al. |

FOREIGN PATENT DOCUMENTS

| | | | |
|---|---|---|---|
| DE | 19616004 | A1 | 10/1997 |
| WO | 2012138507 | A2 | 10/2012 |

OTHER PUBLICATIONS

International Preliminary Report on Patentability for PCT/US2011/058639 dated May 16, 2013, with Written Opinion.

The Second Office Action in CN201180052809.3 dated Jul. 16, 2015, with English translation.

The First Office Action in CN201180052809.3 dated Nov. 24, 2014, with English translation.

Communication in EP11805675.3 dated Feb. 20, 2014.

First Office Action in CN201510885675.3 dated Dec. 5, 2016.

Second Office Action in CN201510885675.3 dated Jul. 25, 2017.

Jun. 5, 2018—(EP) Communication with Search Report—App EP18162204.

FLUID-FILLED CHAMBER WITH A STACKED TENSILE MEMBER

CROSS-REFERENCE TO RELATED APPLICATIONS

This application is a division of U.S. application Ser. No. 16/508,462, filed Jul. 11, 2019, now allowed, which is a division of U.S. application Ser. No. 14/855,523, and filed Sep. 16, 2015, now U.S. Pat. No. 10,383,397 which is a division of U.S. application Ser. No. 12/938,175, now U.S. Pat. No. 9,161,592, each of which is incorporated by reference herein in its entirety.

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace is utilized to modify the dimensions of the void and secure the foot within the void.

The sole structure is located adjacent to a lower portion of the upper and is generally positioned between the foot and the ground. In many articles of footwear, including athletic footwear, the sole structure conventionally incorporates an insole, a midsole, and an outsole. The insole is a thin compressible member located within the void and adjacent to a lower surface of the void to enhance footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

The conventional midsole is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many conventional midsoles are primarily formed from a foamed polymer material, fluid-filled chambers or other non-foam structures may form a majority of some midsole configurations.

SUMMARY

A fluid-filled chamber, which may be incorporated into an article of footwear or a variety of other products, is disclosed below as having a barrier, a stacked tensile member, and a fluid. The barrier may be formed from a polymer material that is sealed to define an interior void. The stacked tensile member may be located within the interior void and includes a first tensile element and a second tensile element that are joined to each other. Additionally, opposite sides of the stacked tensile member are joined to the barrier. The fluid is located within the interior void and may be pressurized to place an outward force upon the barrier and induce tension in the stacked tensile member. In some configurations, each of the tensile elements may be a spacer textile.

A method of manufacturing a fluid-filled chamber is also disclosed below. The method includes securing a first tensile element to a second tensile element to form a stacked tensile member. The stacked tensile member is located between a first polymer layer and a second polymer layer. The first polymer layer is adjacent to a surface of the first tensile element, and the second polymer layer is adjacent to a surface of the second tensile element. Heat and pressure are applied to the first polymer layer, the second polymer layer, and the tensile member to bond (a) the first polymer layer to the surface of the first tensile element, (b) the second polymer layer to the surface of the second tensile element, and (c) the first polymer layer to the second polymer layer around a periphery of the stacked tensile member.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of fluid-filled chambers and methods for manufacturing the chambers. Although the chambers are disclosed with reference to footwear having a configuration that is suitable for running, concepts associated with the chambers may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the chambers may also be utilized with footwear styles that are generally considered to be non-athletic, including dress shoes, loafers, and sandals. In addition to footwear, the chambers may be incorporated into other types of apparel and athletic equipment, including helmets, gloves, and protective padding for sports such as football and hockey. Similar chambers may also be incorporated into cushions and other compressible structures utilized in household goods and industrial products. Accordingly, chambers incorporating the concepts disclosed herein may be utilized with a variety of products.

General Footwear Structure

Figure 1:
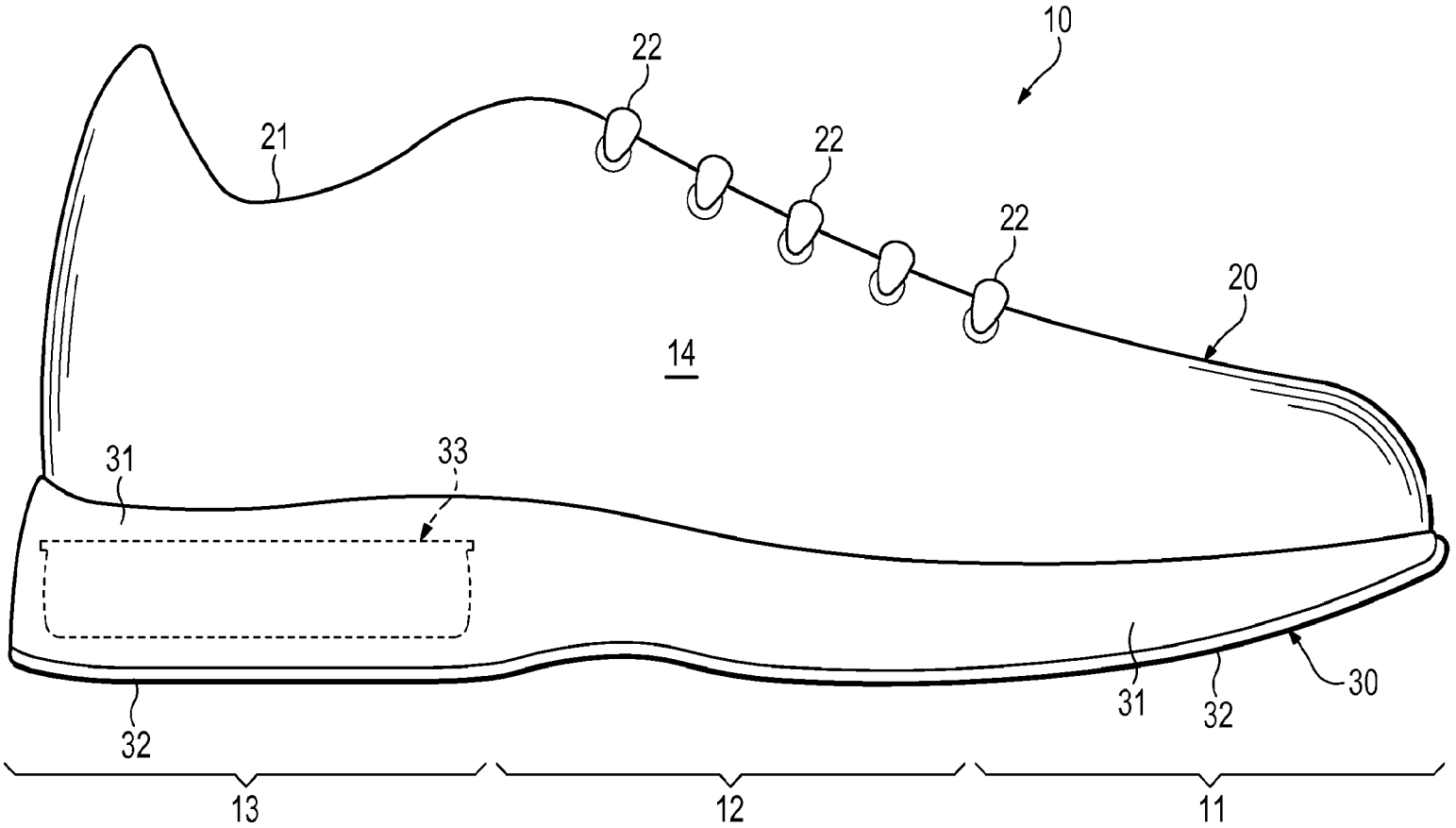
FIG. 1 is a lateral side elevational view of an article of footwear incorporating a first chamber.
Figure 2:
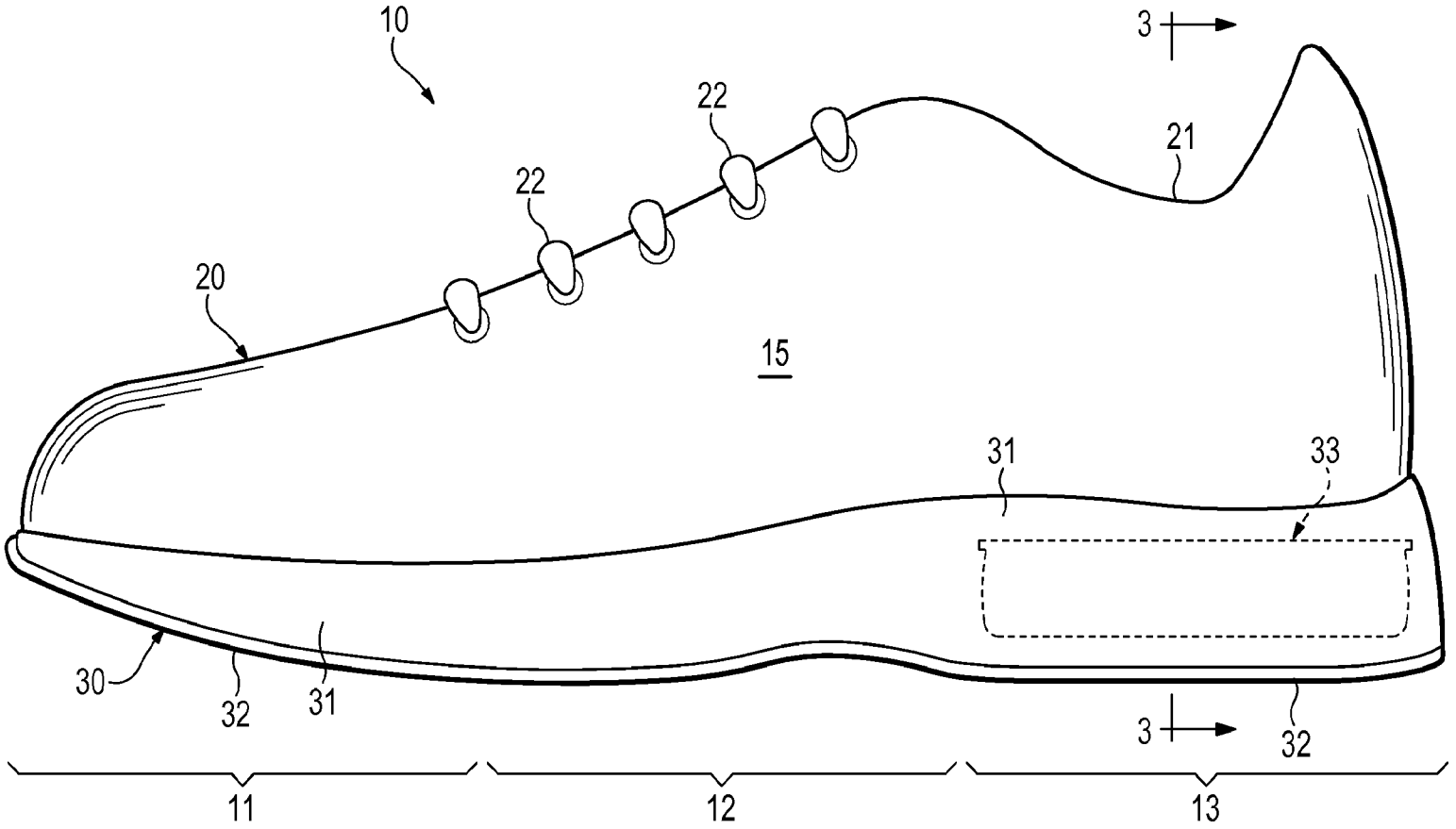
FIG. 2 is a medial side elevational view of the article of footwear.
Figure 3:
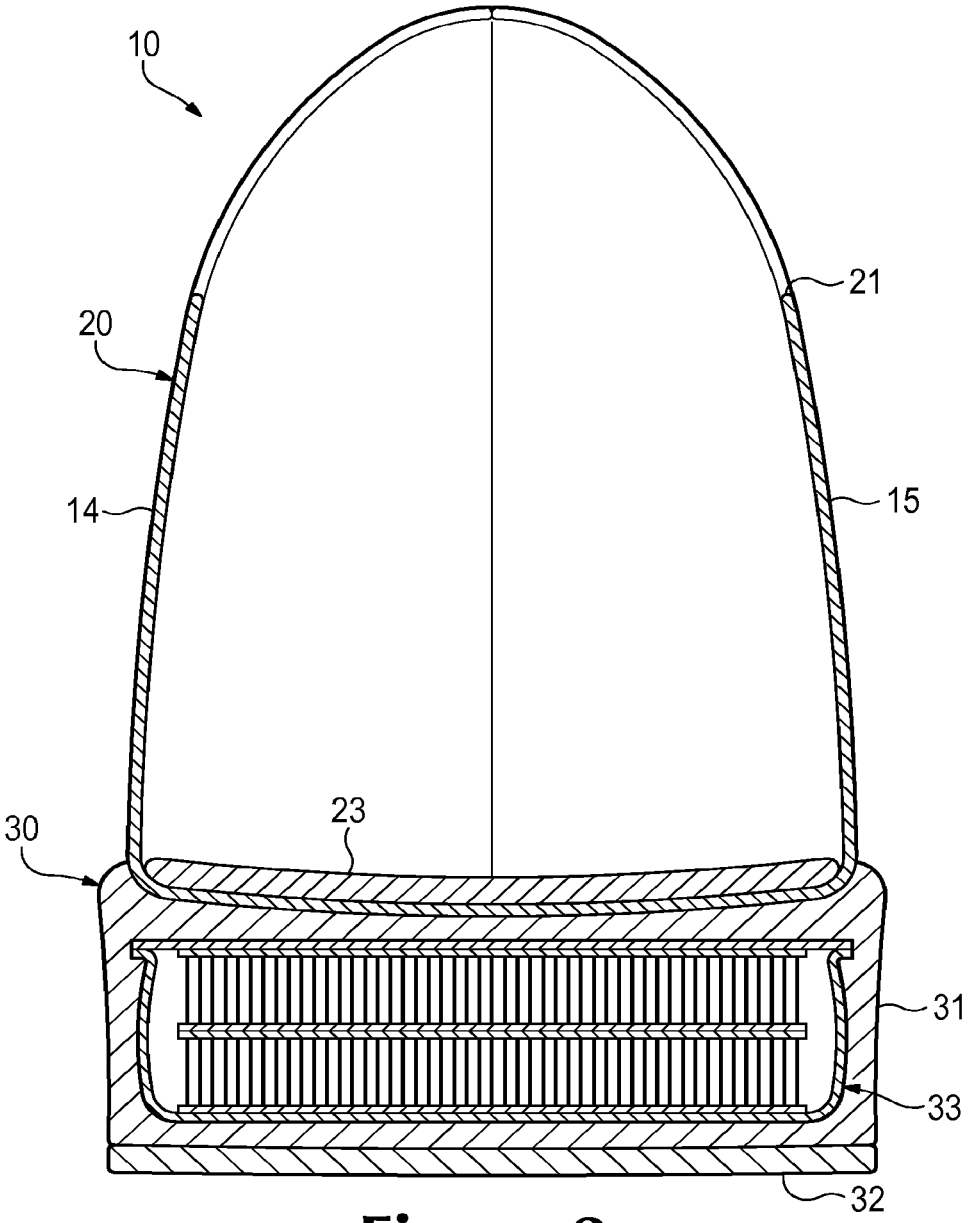
FIG. 3 is a cross-sectional view of the article of footwear, as defined by section line 3-3 in FIG. 2.

An article of footwear 10 is depicted in FIGS. 1-3 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textile, foam, leather, and synthetic leather) that are stitched, adhered, bonded, or otherwise joined together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Upper 20 may also incorporate a sockliner 23 that is located with in the void in upper 20 and adjacent a plantar (i.e., lower) surface of the foot to enhance the comfort of footwear 10. Given that various aspects of the present application primarily relate to sole structure 30, upper 20 may exhibit the general configuration discussed above or the general configuration of practically any other conventional or non-conventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation. The primary elements of sole structure 30 are a midsole 31 and an outsole 32. Midsole 31 may be formed from a polymer foam material, such as polyurethane or ethylvinylacetate, that encapsulates a fluid-filled chamber 33. In addition to the polymer foam material and chamber 33, midsole 31 may incorporate one or more additional footwear elements that enhance the comfort, performance, or ground reaction force attenuation properties of footwear 10, including plates, moderators, lasting elements, or motion control members. Outsole 32, which may be absent in some configurations of footwear 10, is secured to a lower surface of midsole 31 and may be formed from a rubber material that provides a durable and wear-resistant surface for engaging the ground. In addition, outsole 32 may also be textured to enhance the traction (i.e., friction) properties between footwear 10 and the ground.

Figure 4A:
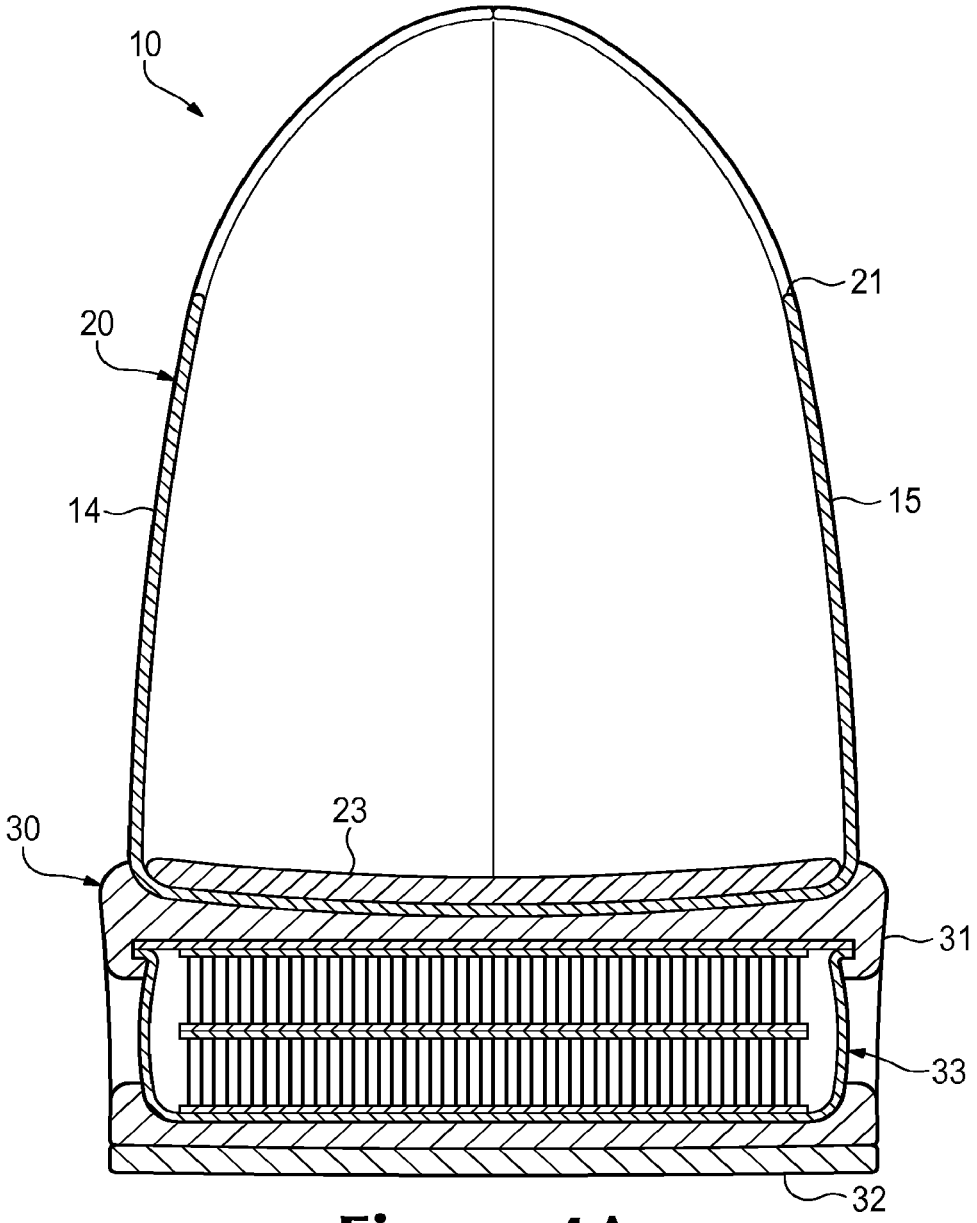
FIGS. 4A-4C are cross-sectional views corresponding with FIG. 3 and depicting further configurations of the article of footwear.
Figure 4B:
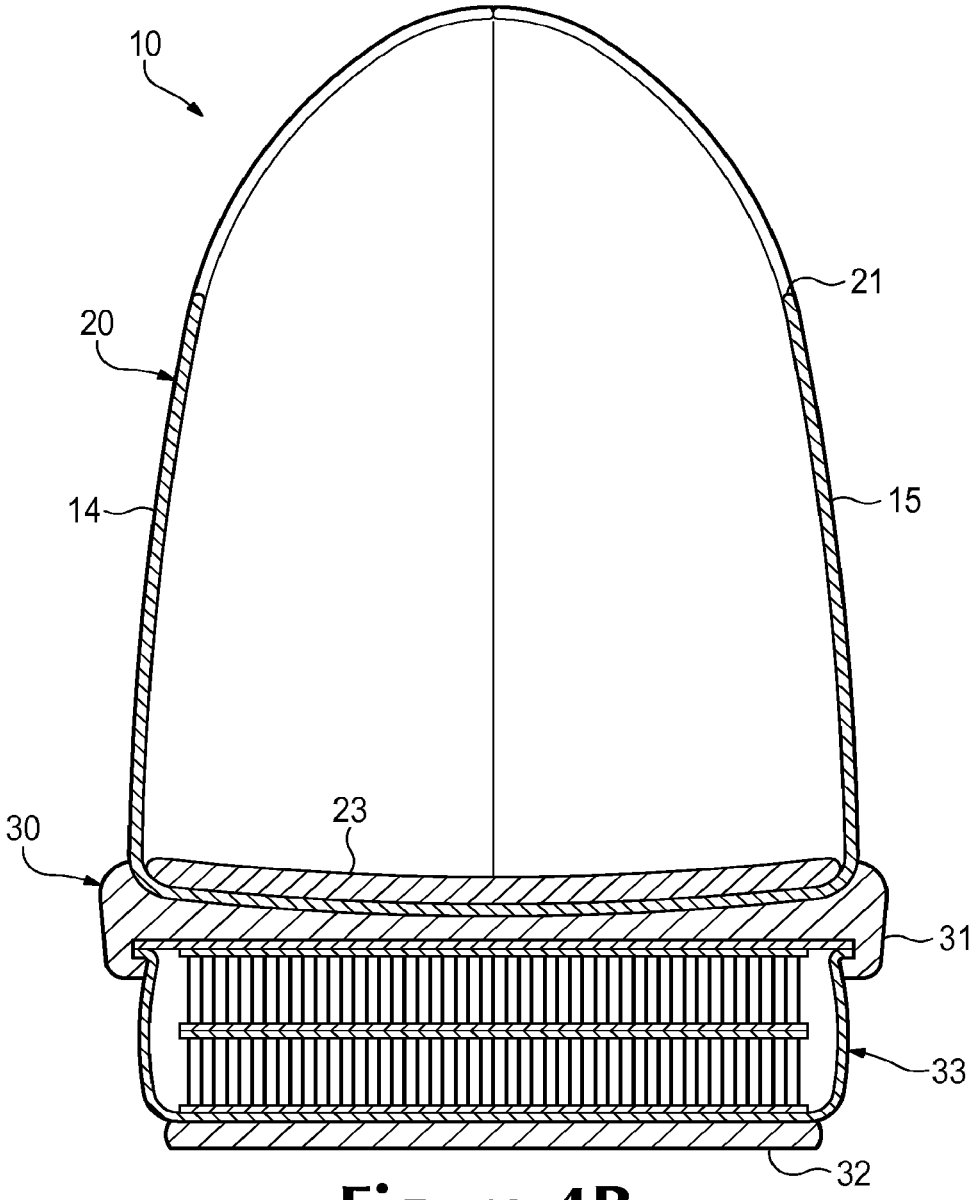
Figure 4C:
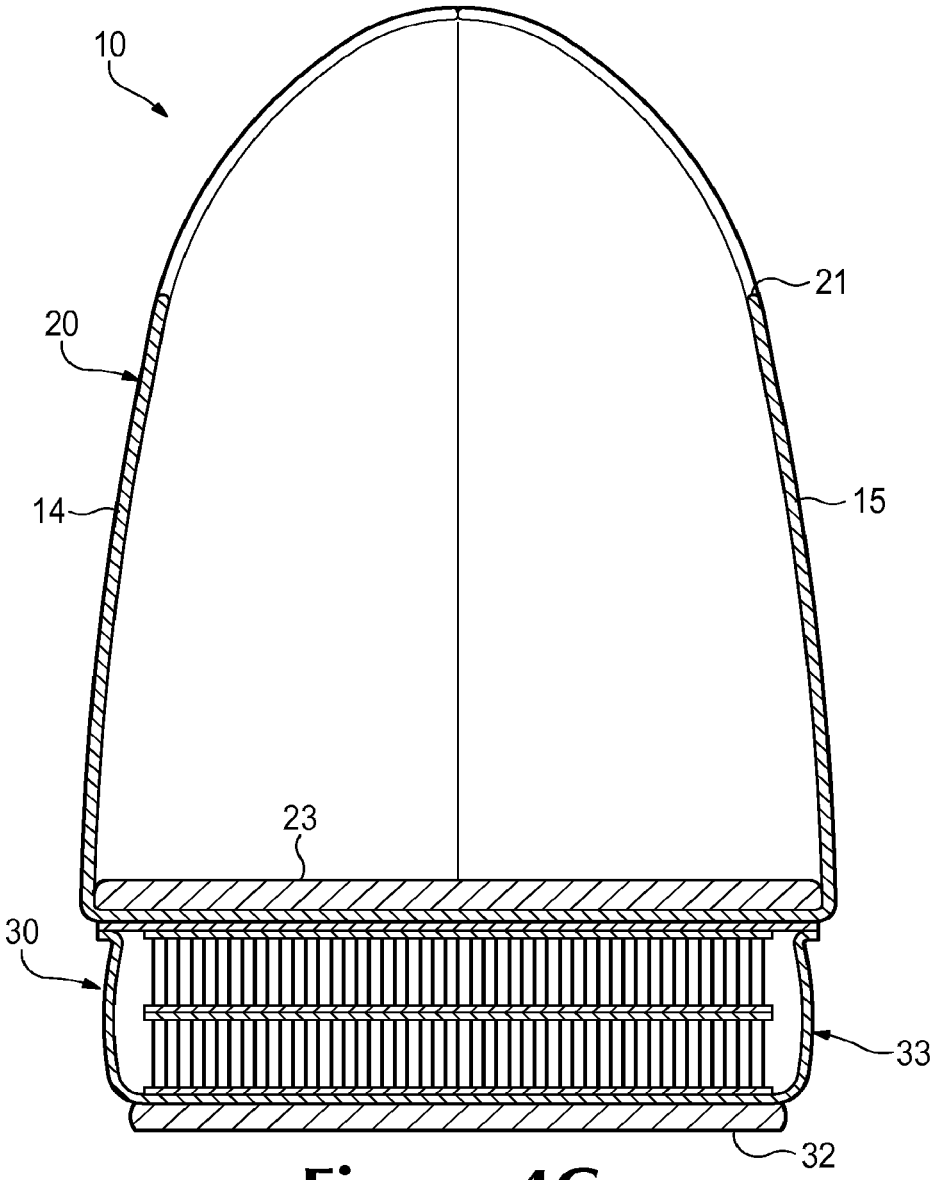
Figure 5:
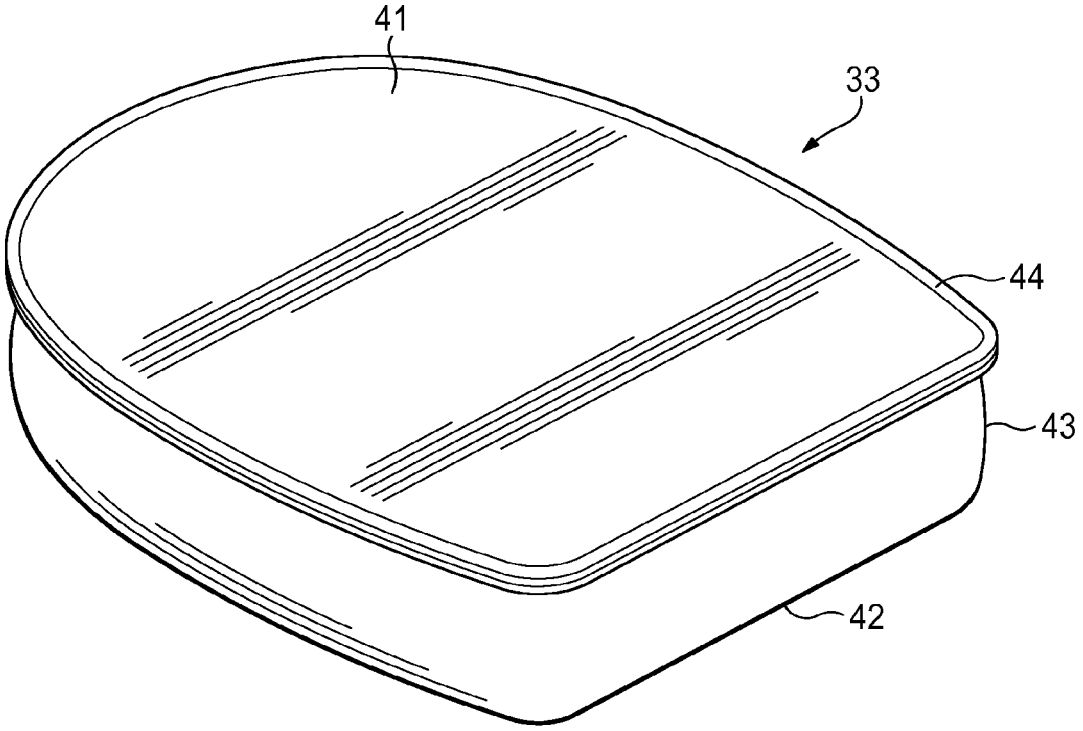
FIG. 5 is a perspective view of the first chamber.
Figure 6:
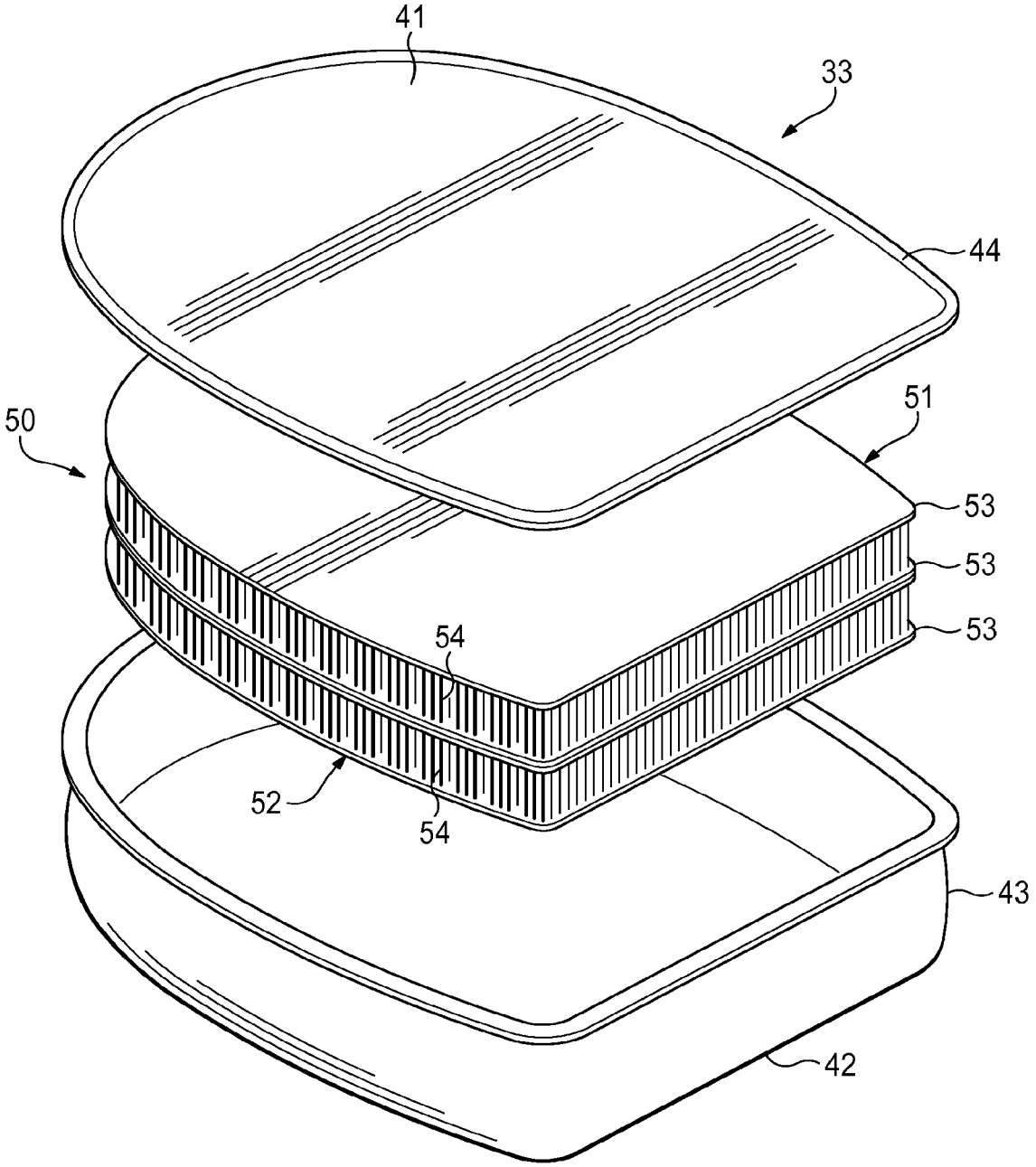
FIG. 6 is an exploded perspective view of the first chamber.
Figure 7:
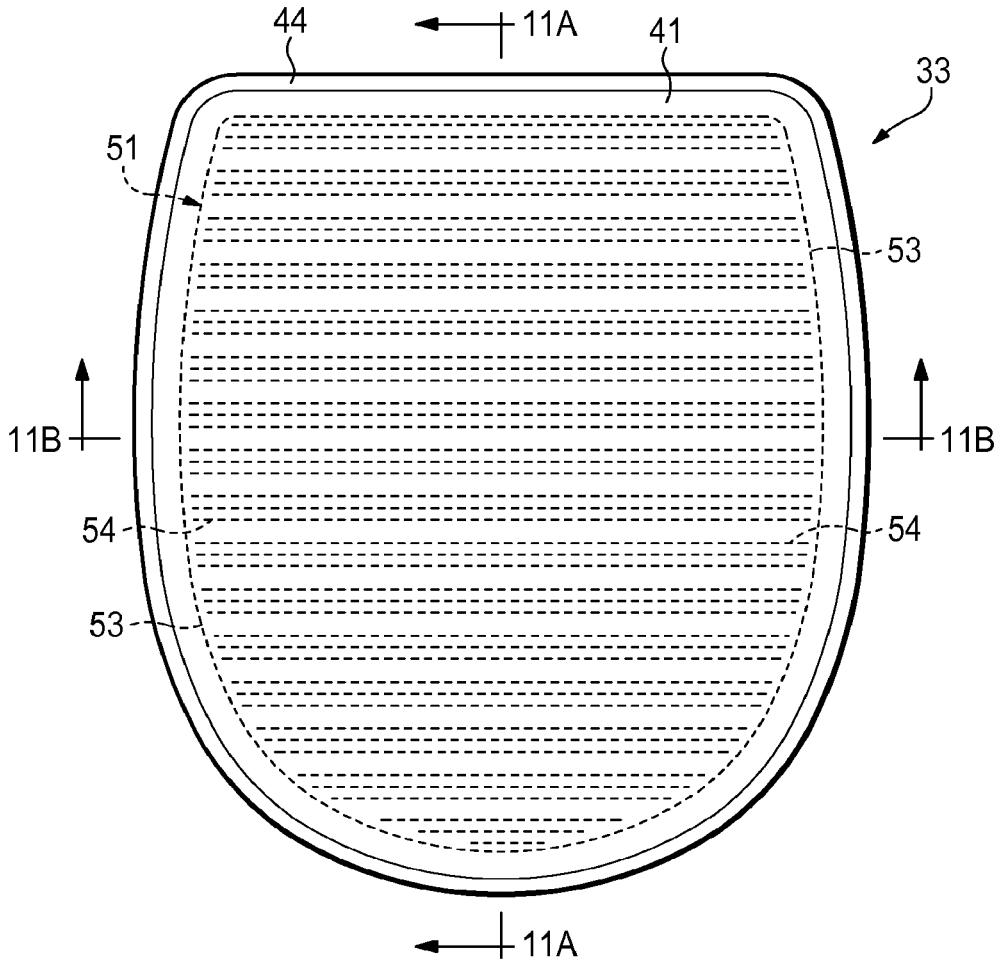
FIG. 7 is a top plan view of the first chamber.
Figure 8:
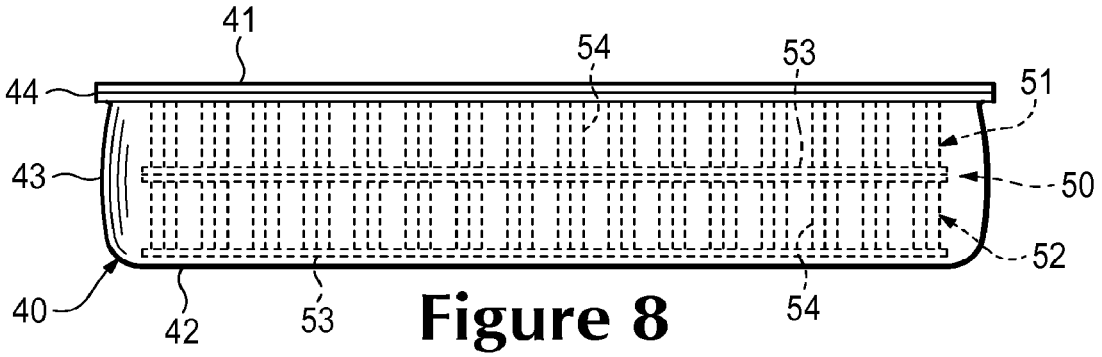
FIG. 8 is a lateral side elevational view of the first chamber.
Figure 9:
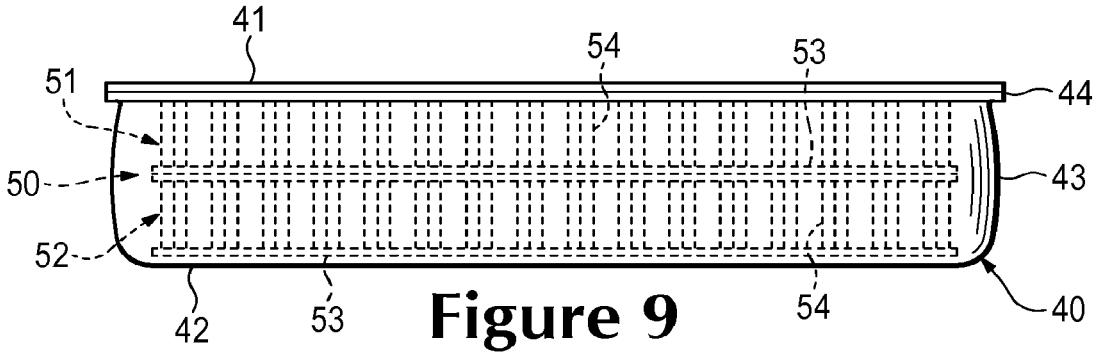
FIG. 9 is a medial side elevational view of the first chamber.
Figure 10:
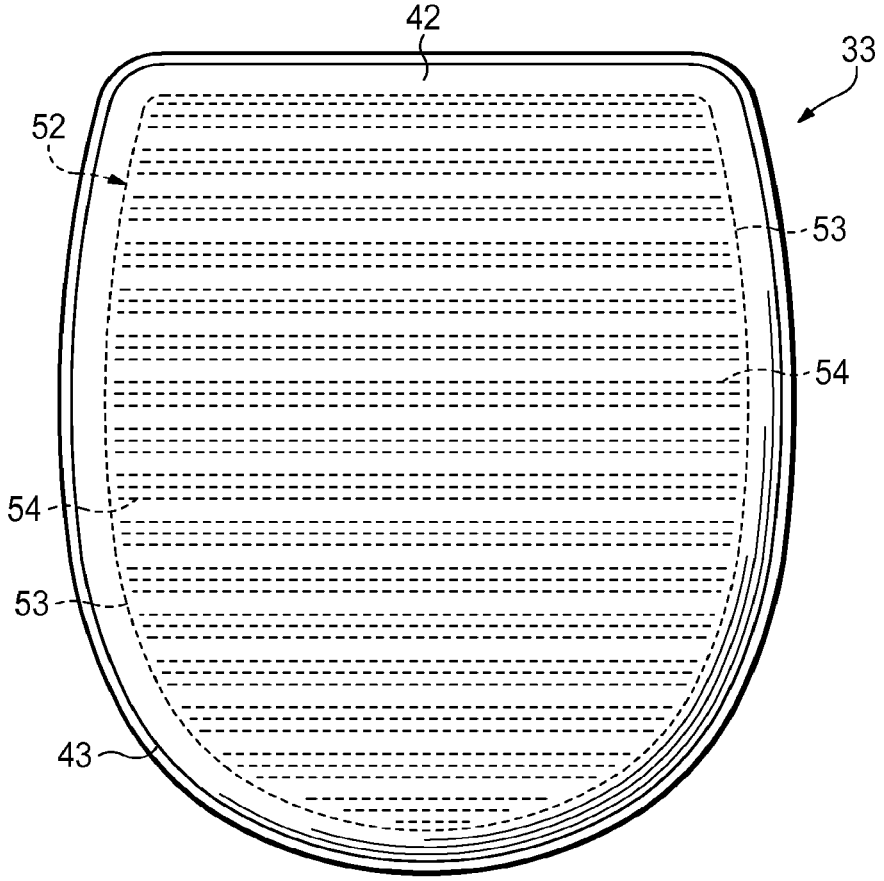
FIG. 10 is a bottom plan view of the first chamber.

As incorporated into footwear 10, chamber 33 has a shape that fits within a perimeter of midsole 31 and is primarily located in heel region 13. When the foot is located within upper 20, chamber 33 extends under a heel area of the foot (i.e., under a calcaneus bone of the wearer) in order to attenuate ground reaction forces that are generated when sole structure 30 is compressed between the foot and the ground during various ambulatory activities, such as running and walking. In other configurations, chamber 33 may extend from forefoot region 11 to heel region 13 and also from lateral side 14 to medial side 15, thereby having a shape that corresponds with an outline of the foot and extends under substantially all of the foot. As depicted in FIG. 3, chamber 33 is substantially surrounded or otherwise encapsulated by midsole 31. In some configurations, however, chamber 33 may be at least partially exposed, as in FIG. 4A. Although the polymer foam material of midsole 31 may extend over and under chamber 33, FIG. 4B depicts a configuration wherein outsole 32 is secured to a lower surface of chamber 33. Similarly, FIG. 4C depicts a configuration wherein the polymer foam material of midsole 31 is absent and chamber 33 is secured to both upper 20 and outsole 32. Accordingly, the overall shape of chamber 33 and the manner in which chamber 33 is incorporated into footwear 10 may vary significantly.

Although chamber 33 is depicted and discussed as being a sealed chamber within footwear 10, chamber 33 may also be a component of a fluid system within footwear 10. For example, pumps, conduits, and valves may be joined with chamber 33 to provide a fluid system that pressurizes chamber 33 with air from the exterior of footwear 10. More particularly, chamber 33 may be utilized in combination with any of the fluid systems disclosed in U.S. Pat. No. 7,210,249 to Passke, et al. and U.S. Pat. No. 7,409,779 to Dojan, et al.

Chamber Configuration

Chamber 33 is depicted individually in FIGS. 5-11B and includes a barrier 40 and a stacked tensile member 50. Barrier 40 forms an exterior of chamber 33 and (a) defines an interior void that receives both a pressurized fluid and stacked tensile member 50 and (b) provides a durable sealed barrier for retaining the pressurized fluid within chamber 33. The polymer material of barrier 40 includes an upper barrier portion 41, an opposite lower barrier portion 42, and a sidewall barrier portion 43 that extends around a periphery of chamber 33 and between barrier portions 41 and 42. Stacked tensile member 50 is located within the interior void and includes an upper tensile element 51 and a lower tensile element 52 with an overlapping configuration. Opposite sides of stacked tensile member 50 are joined to barrier 40. The terms "upper" and "lower" in reference to barrier portions 41 and 42, tensile elements 51 and 52, and other components discussed below correspond with the orientation of chamber 33 in the figures and are not intended to indicate a preferred orientation for chamber 33. In other words, chamber 33 may be oriented in any manner.

Each of tensile elements 51 and 52 are spacer textiles (also referred to as a spacer-knit textiles) that include a pair of textile layers 53 a plurality of connecting members 54 extending between textile layers 53. That is, upper tensile element 51 includes two textile layers 53 with connecting members 54 extending therebetween, and lower tensile element 52 includes two more textile layers 53 with additional connecting members 54 extending therebetween. Whereas upper tensile element 51 is secured to an inner surface of upper barrier portion 41, lower tensile element 52 is secured to an inner surface of lower barrier portion 42. More particularly, one of textile layers 53 from upper tensile element 51 is secured to the inner surface of upper barrier portion 41, and one of textile layers 53 from lower tensile element 52 is secured to the inner surface of lower barrier portion 42. Additionally, centrally-located textile layers 53 from each of tensile members 51 and 52 are secured to each other, thereby joining tensile elements 51 and 52.

Textile layers 53 exhibit a generally continuous, planar, and parallel configuration. Connecting members 54 are secured to textile layers 53 and space textile layers 53 apart from each other. When incorporated into chamber 33, an outward force of the pressurized fluid places connecting members 54 in tension and restrains further outward movement of textile layers 53 and barrier portions 41 and 42. Connecting members 54 are arranged in rows that are separated by gaps. The use of gaps provides stacked tensile member 50 with increased compressibility in comparison to tensile members formed of double-walled fabrics that utilize continuous connecting members, although continuous connecting members 54 may be utilized in some configurations of chamber 33.

The lengths of connecting members 54 are substantially constant throughout stacked tensile member 50, which imparts the parallel configuration to each of textile layers 53. In some configurations, however, the lengths of connecting members 54 may vary to impart a contoured configuration to chamber 33. For example, chamber 33 may taper or may form a depression due to differences in the lengths of connecting members 54. Examples of contoured tensile members are disclosed in U.S. patent application Ser. No. 12/123,612 to Dua and Ser. No. 12/123,646 to Rapaport, et al. Each of tensile elements 51 and 52 may be cut or formed from a larger element of a spacer textile. Alternately, each of tensile elements 51 and 52 may be formed to have a variety of configurations through, for example, a flat-knitting process, as in U.S. patent application Ser. No. 12/123,612 to Dua.

In manufacturing chamber 33, a pair of polymer sheets may be molded and bonded during a thermoforming process to define barrier portions 41-43. More particularly, the thermoforming process (a) imparts shape to one of the polymer sheets in order to form upper barrier portion 41, (b) imparts shape to the other of the polymer sheets in order to form lower barrier portion 42 and sidewall barrier portion 43, and (c) forms a peripheral bond 44 that joins a periphery of the polymer sheets. Peripheral bond 44 is depicted as being adjacent to the upper surface of chamber 33, but may be positioned between the upper and lower surfaces or may be adjacent to the lower surface. The thermoforming process may also (a) locate stacked tensile member 50 within chamber 33 and (b) bond stacked tensile member 50 to each of barrier portions 41 and 42. Although substantially all of the thermoforming process may be performed with a mold, as described in greater detail below, each of the various parts or steps of the process may be performed separately in forming chamber 33. That is, a variety of other methods may be utilized to form chamber 33.

Following the thermoforming process, a fluid may be injected into the interior void and pressurized between zero and three-hundred-fifty kilopascals (i.e., approximately fifty-one pounds per square inch) or more. The pressurized fluid exerts an outward force upon chamber 33, which tends to separate barrier portions 41 and 42. Stacked tensile member 50, however, is secured to each of barrier portions 41 and 42 in order to retain the intended shape of chamber 33 when pressurized. More particularly, connecting members 53 extend across the interior void and are placed in tension by the outward force of the pressurized fluid upon barrier 40, thereby preventing barrier 40 from expanding outward and retaining the intended shape of chamber 33. Whereas peripheral bond 44 joins the polymer sheets to form a seal that prevents the fluid from escaping, stacked tensile member 50 prevents chamber 33 from expanding outward or otherwise distending due to the pressure of the fluid. That is, stacked tensile member 50 effectively limits the expansion of chamber 33 to retain an intended shape of surfaces of barrier portions 41 and 42. In addition to air and nitrogen, the fluid may include octafluorapropane or be any of the gasses disclosed in U.S. Pat. No. 4,340,626 to Rudy, such as hexafluoroethane and sulfur hexafluoride. In some configurations, chamber 33 may incorporate a valve or other structure that permits the pressure of the fluid to be adjusted.

A wide range of polymer materials may be utilized for barrier 40. In selecting a material for barrier 40, engineering properties of the material (e.g., tensile strength, stretch properties, fatigue characteristics, dynamic modulus, and loss tangent) as well as the ability of the material to prevent the diffusion of the fluid contained by barrier 40 may be considered. When formed of thermoplastic urethane, for example, barrier 40 may have a thickness of approximately 1.0 millimeter, but the thickness may range from 0.25 to 2.0 millimeters or more, for example. In addition to thermoplastic urethane, examples of polymer materials that may be suitable for chamber 33 include polyurethane, polyester, polyester polyurethane, and polyether polyurethane. Barrier 40 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for barrier 40 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

In order to facilitate bonding between stacked tensile member 50 and barrier 40, polymer supplemental layers may be applied to each of textile layers 53. When heated, the supplemental layers soften, melt, or otherwise begin to change state so that contact with barrier portions 41 and 42 induces material from each of barrier 40 and the supplemental layers to intermingle or otherwise join with each other. Upon cooling, therefore, the supplemental layers are permanently joined with barrier 40, thereby joining stacked tensile member 50 with barrier 40. In some configurations, thermoplastic threads or strips may be present within textile layers 53 to facilitate bonding with barrier 40, as disclosed in U.S. Pat. No. 7,070,845 to Thomas, et al., or an adhesive may be utilized to secure barrier 40 and tensile member 50. One or more polymer supplemental layers may also be utilized to join tensile elements 51 and 52 to each other, or an adhesive or stitching may be utilized. Accordingly, various techniques may be used to join stacked tensile member 50 to barrier 40 and to join tensile elements 51 and 52 to each other.

Figure 12A:
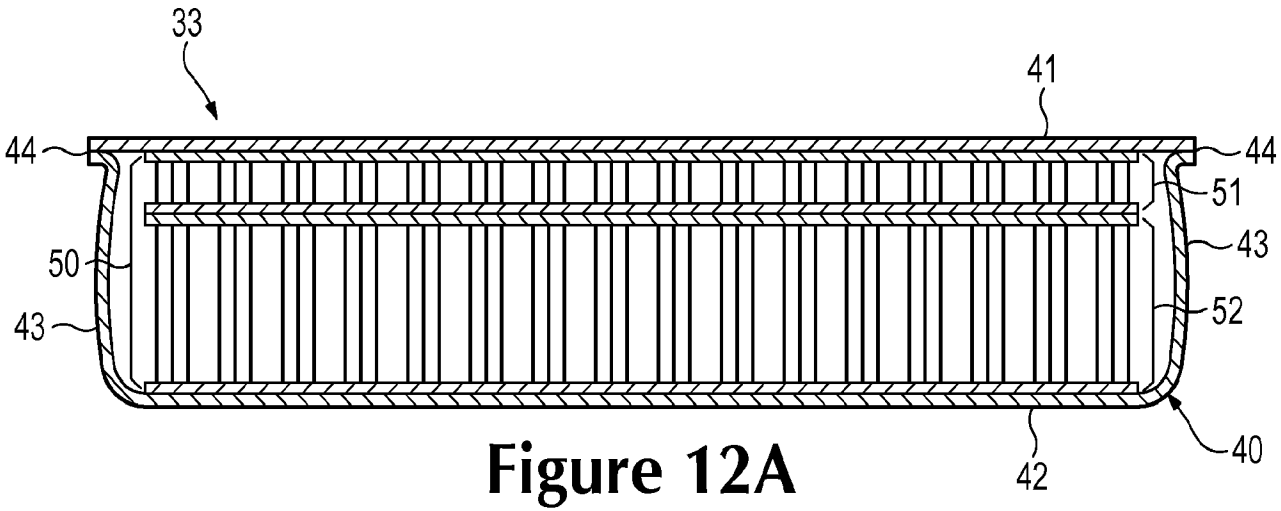
FIGS. 12A-12D are cross-sectional views corresponding with FIG. 11A and depicting further configurations of the first chamber.
Figure 12B:
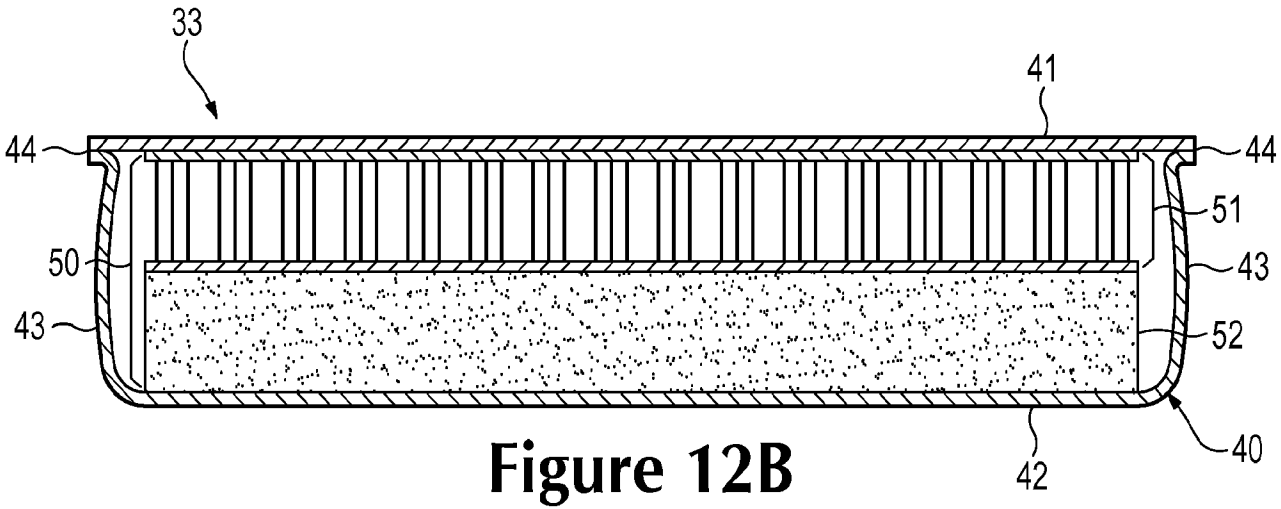

The overall configuration of chamber 33 discussed above provides an example of a suitable configuration for use in footwear 10. A variety of other configurations may, however, be utilized. As an example, each of tensile elements 51 and 52 are shown as having substantially identical thicknesses (e.g., 13 millimeters each), but may have different thicknesses, as depicted in FIG. 12A. More particularly, lower textile element 52 is depicted as having a greater thickness than upper textile element 51. Although each of tensile elements 51 and 52 may be spacer textiles, the overall configuration of tensile elements 51 and 52 may vary considerably. As an example, FIG. 12B depicts a configuration wherein lower tensile element 52 is a polymer foam member, whereas upper tensile element 51 is a spacer textile. As another example, U.S. Pat. No. 7,131,218 to Schindler discloses a foam tensile member. In some configurations either or both of tensile elements 51 and 52 may be other forms of tensile elements. As an example, U.S. patent application Ser. No. 12/630,642 discloses a variety of tether elements that may be incorporated into fluid-filled chambers. Accordingly, other materials or objects may be utilized as either of tensile elements 51 and 52.

Figure 11A:
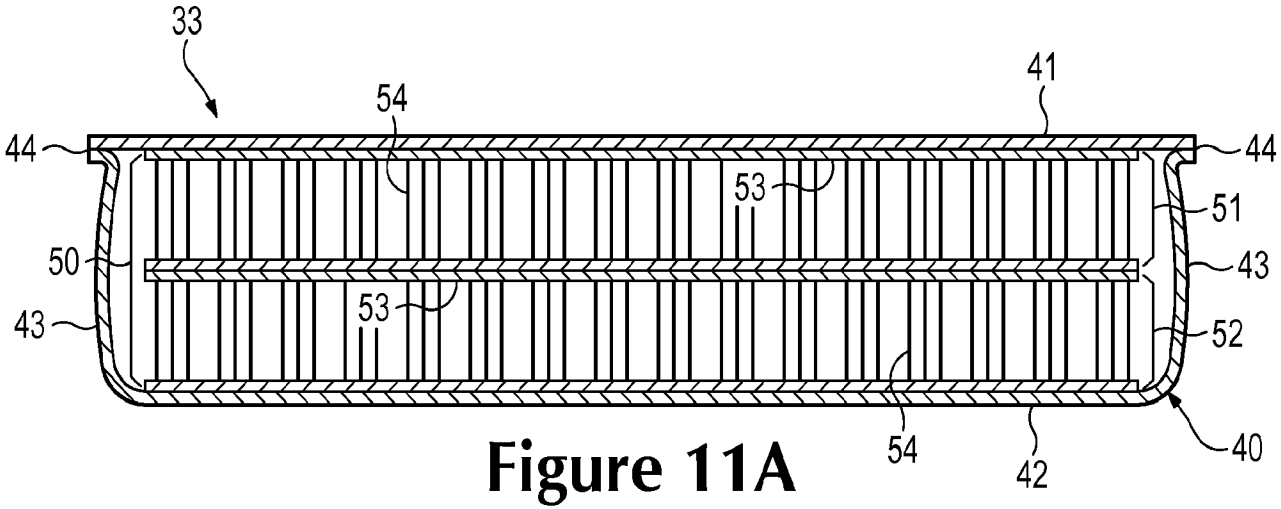
FIGS. 11A and 11B are cross-sectional views of the first chamber, as defined by section lines 11A and 11B in FIG. 7.
Figure 11B:
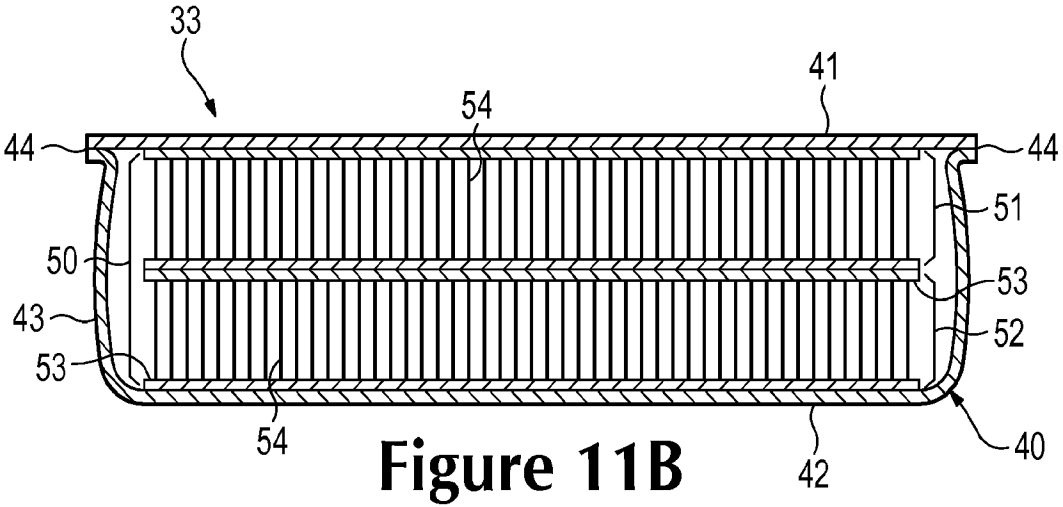
Figure 12C:
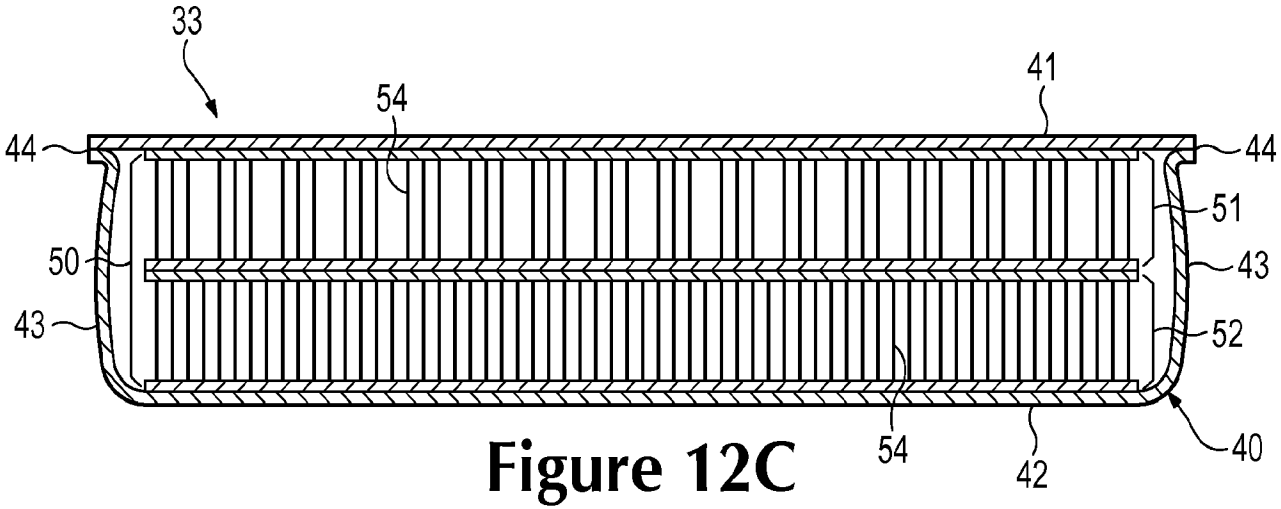
Figure 12D:
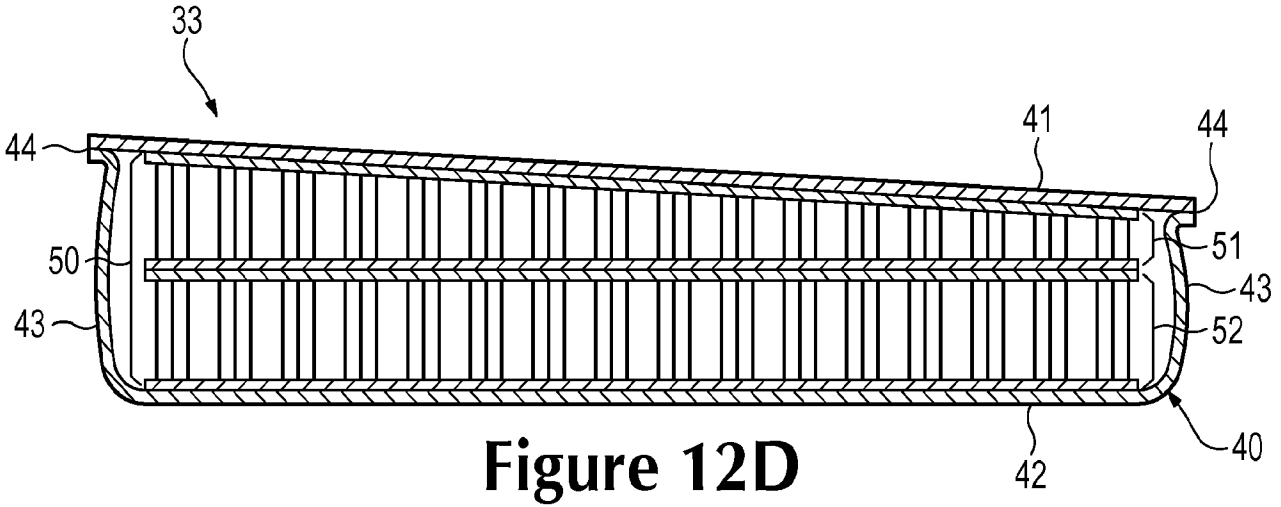

As discussed above, connecting members 54 are arranged in rows that are separated by gaps. Referring to FIGS. 11A and 11B, the rows are aligned and extend in the same direction (i.e., across a width of chamber 33). The rows may, however, be unaligned, perpendicular, or otherwise offset, which may affect the shear properties of chamber 33. As an example, FIG. 12C depicts a configuration wherein the rows formed by connecting members 54 are not aligned. As an additional matter, FIG. 12D depicts a configuration wherein upper tensile element 51 is tapered to impart a tapered configuration to chamber 33.

Based upon the above discussion, chamber 33 includes barrier 40, stacked tensile member 50, and a fluid (e.g., a pressurized fluid). Barrier 40 is formed from a polymer material that defines an interior void. Stacked tensile member 50 is located within the interior void. In one configuration, stacked tensile member 50 includes tensile elements 51 and 52 with the configuration of spacer textiles that overlap each other or exhibit a stacked configuration, but may have other configurations. Outward facing surfaces of tensile member 50 are joined to the polymer material of barrier 40. For example, the outward facing surface of upper tensile element 51 is joined to upper barrier portion 41, and the outward facing surface of lower tensile element 52 is joined to lower barrier portion 42. The fluid is located within the interior void and may be pressurized to place an outward force upon barrier 40 and induce tension in stacked tensile member 50.

Chamber 33 is discussed above as having a configuration that is suitable for footwear. In addition to footwear, chambers having similar configurations may be incorporated into other types of apparel and athletic equipment, including helmets, gloves, and protective padding for sports such as football and hockey. Similar chambers may also be incorporated into cushions and other compressible structures utilized in household goods and industrial products.

Manufacturing Process

Figure 13:
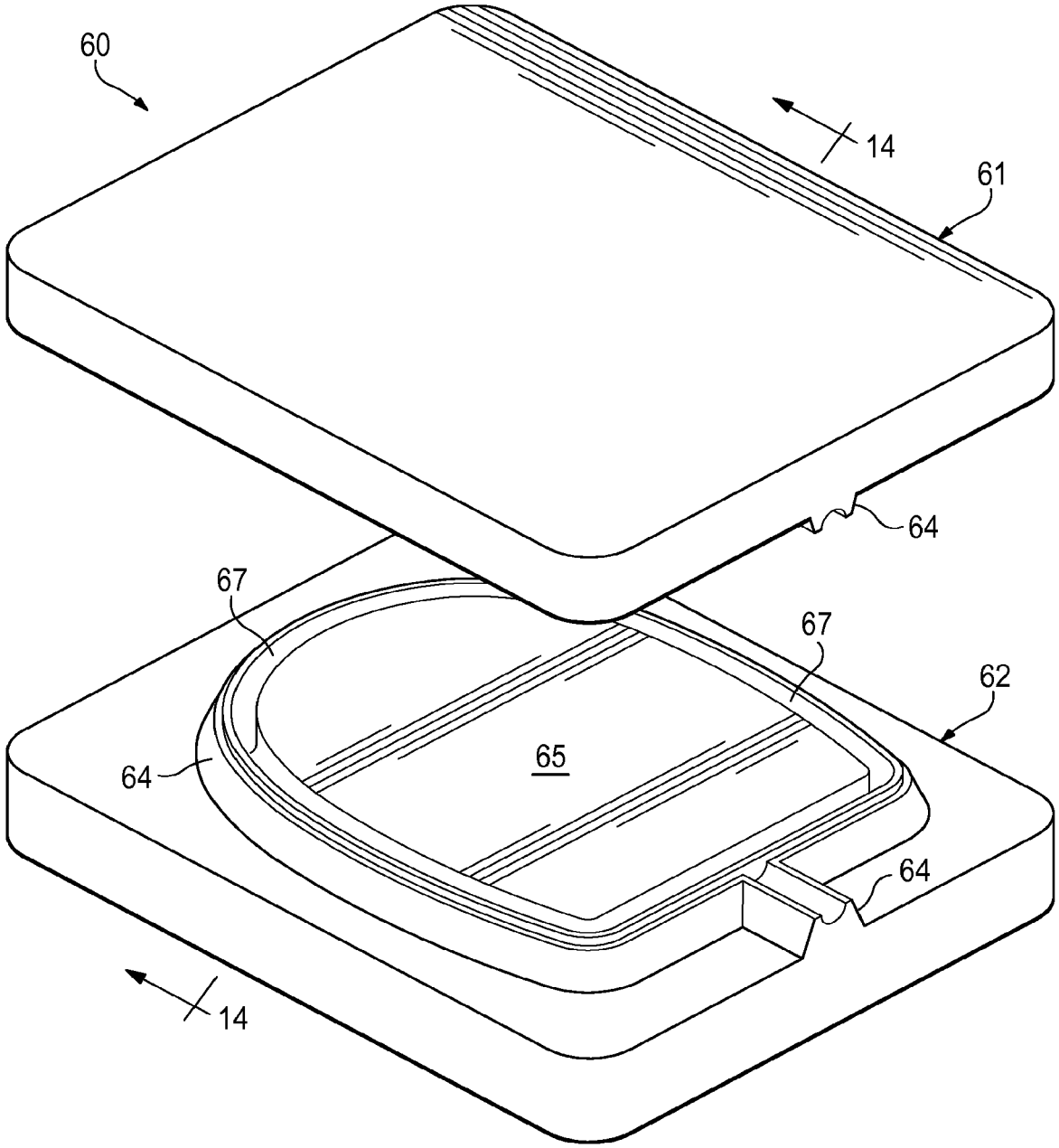
FIG. 13 is a perspective view of a mold for forming the first chamber.

Although a variety of manufacturing processes may be utilized to form chamber 33, an example of a suitable thermoforming process will now be discussed. With reference to FIG. 13, a mold 60 that may be utilized in the thermoforming process is depicted as including an upper mold portion 61 and a lower mold portion 62. Mold 60 is utilized to form chamber 33 from a pair of polymer sheets that are molded and bonded to define barrier portions 41-43, and the thermoforming process secures tensile member 50 within barrier 40. More particularly, mold 60 (*a*) imparts shape to one of the polymer sheets in order to form upper barrier portion 41, (b) imparts shape to the other of the polymer sheets in order to form lower barrier portion 42 and sidewall barrier portion 43, (c) forms peripheral bond 44 to join a periphery of the polymer sheets, (d) locates stacked tensile member 50 within chamber 33, and (e) bond stacked tensile member 50 to each of barrier portions 41 and 42.

In preparation for the manufacturing process, various elements forming chamber 33 may be obtained and organized. For example, an upper polymer layer 71 and a lower polymer layer 72, which form barrier 40, may be cut to a desired shape, and two sections of a spacer textile (i.e., tensile elements 51 and 52) may be joined to form stacked tensile member 50. As discussed above, a supplemental layer of a polymer material may be utilized to join tensile elements 51 and 52. More particularly, the supplemental layer may be placed between tensile elements 51 and 52 and then heated, thereby inducing the polymer material to infiltrate the structures of textile layers 53. Upon cooling, tensile elements 51 and 52 are effectively joined together. As an alternative, an adhesive or stitching may be utilized to join tensile elements 51 and 52. At this stage, supplemental layers may also be applied to outward-facing textile layers 53 in order to ensure bonding with barrier 40 later in the manufacturing process. As a further matter, stacked tensile member 50 is in a compressed state at this stage of the manufacturing process, wherein textile layers 53 lay adjacent to each other and connecting members 54 are in a collapsed state. Upon completion of the manufacturing process, when chamber 33 is pressurized, stacked tensile member 50 is placed in tension, which spaces textile layers 53 from each other and induces connecting members 54 to straighten In manufacturing chamber 33, one or more of an upper polymer layer 71, a lower polymer layer 72, and stacked tensile member 50 are heated to a temperature that facilitates bonding between the components. Depending upon the specific materials utilized for stacked tensile member 50 and polymer layers 71 and 72, which form barrier 40, suitable temperatures may range from 120 to 200 degrees Celsius (248 to 392 degrees Fahrenheit) or more. Various radiant heaters or other devices may be utilized to heat the components of chamber 33. In some manufacturing processes, mold 60 may be heated such that contact between mold 60 and the components of chamber 33 raises the temperature of the components to a level that facilitates bonding.

Figure 14A:
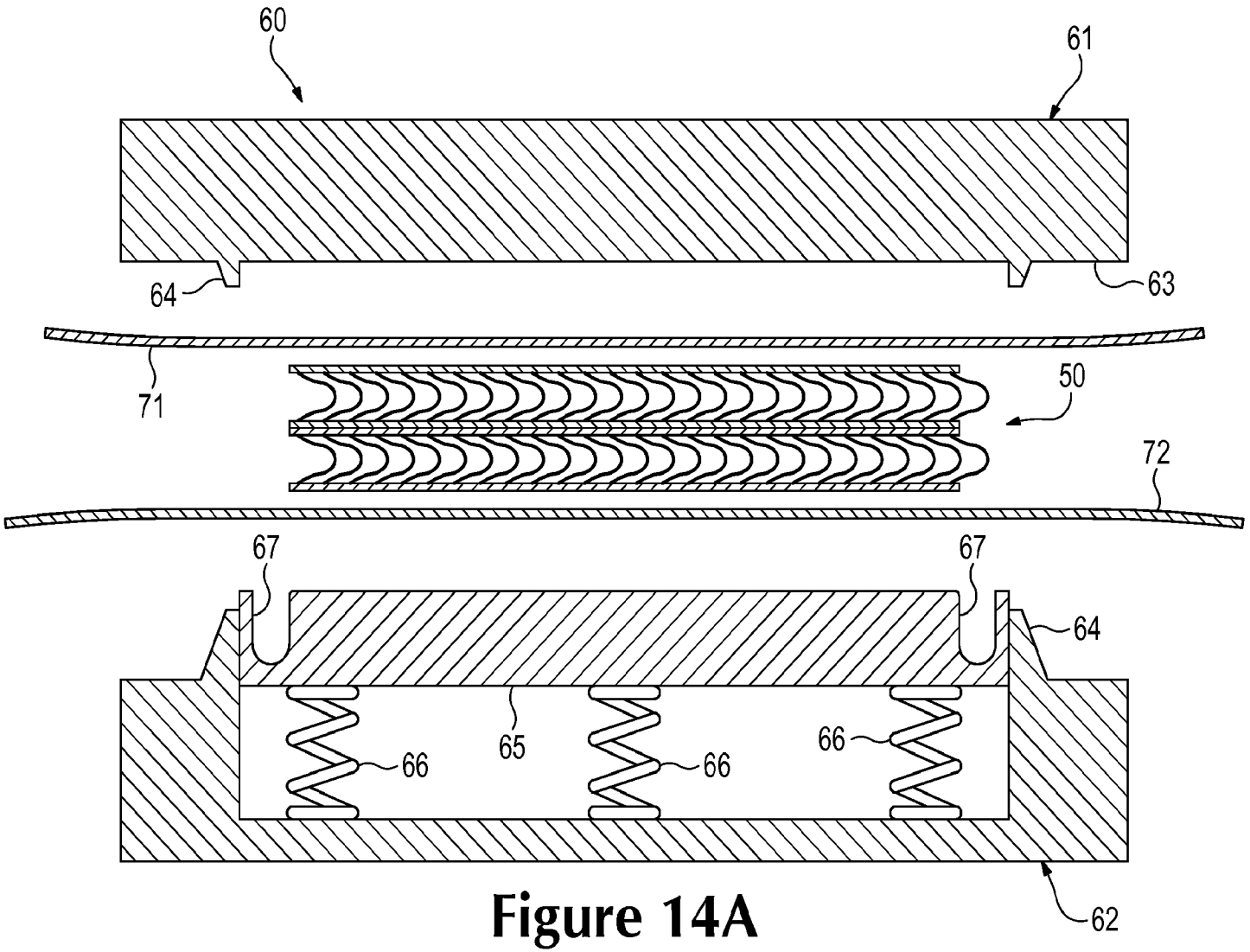
FIGS. 14A-14C are schematic cross-sectional views of the mold, as defined by section line 14 in FIG. 13, depicting steps in a manufacturing process for the first chamber.
Figure 14B:
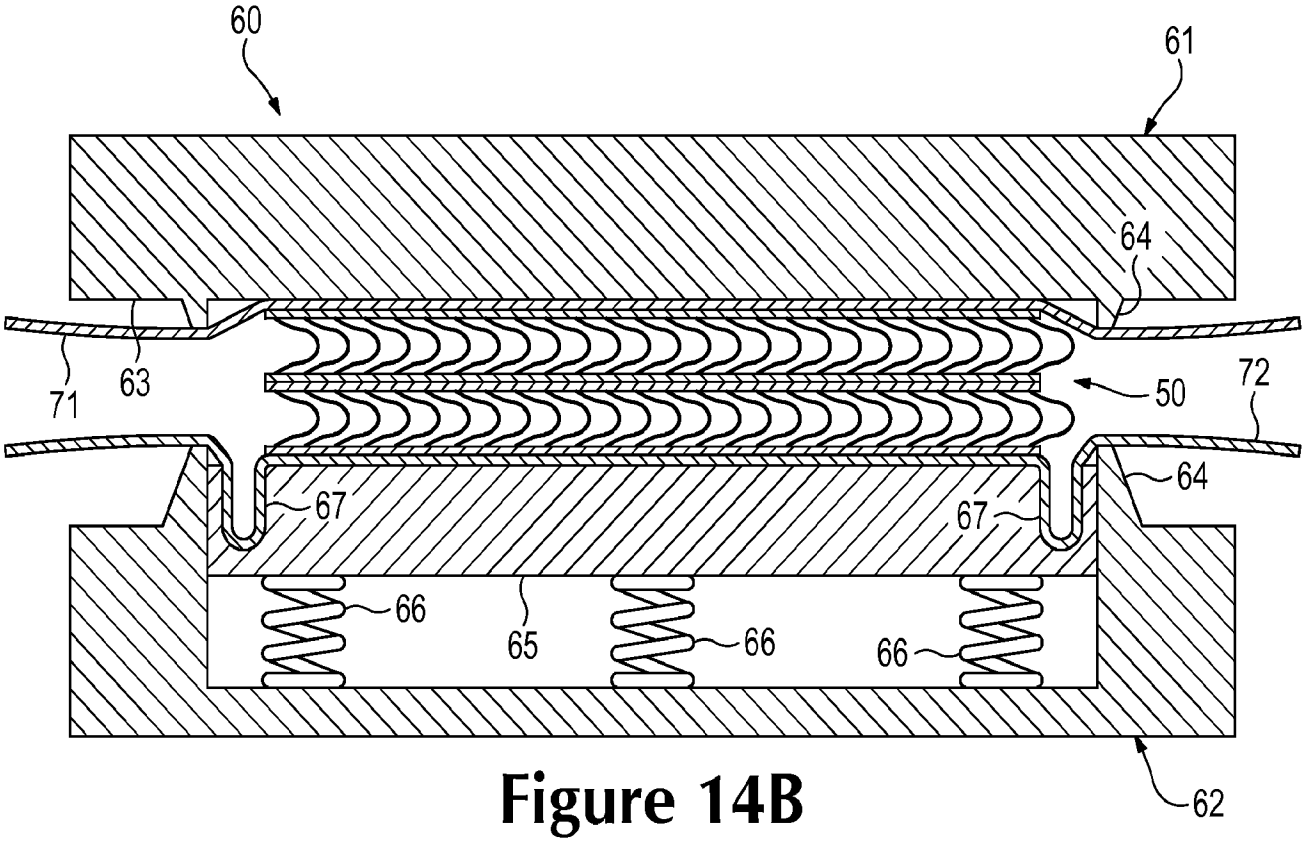

Following heating, the components of chamber 33 are located between mold portions 61 and 62, as depicted in FIG. 14A. In order to properly position the components, a shuttle frame or other device may be utilized. Once positioned, mold portions 61 and 62 translate toward each other and begin to close upon the components such that (a) a surface 63 a ridge 64 of upper mold portion 61 contacts upper polymer layer 71, (b) a ridge 64 of lower mold portion 62 contacts lower polymer layer 72, and (c) polymer layers 71 and 72 begin bending around tensile member 50 so as to extend into a cavity within mold 60, as depicted in FIG. 14B. Accordingly, the components are located relative to mold 60 and initial shaping and positioning has occurred.

At the stage depicted in FIG. 14B, air may be partially evacuated from the area around polymer layers 71 and 72 through various vacuum ports in mold portions 61 and 62. The purpose of evacuating the air is to draw polymer layers 71 and 72 into contact with the various contours of mold 60. This ensures that polymer layers 71 and 72 are properly shaped in accordance with the contours of mold 60. Note that polymer layers 71 and 72 may stretch in order to extend around tensile member 50 and into mold 60. In comparison with the thickness of barrier 40 in chamber 33, polymer layers 71 and 72 may exhibit greater original thickness. This difference between the original thicknesses of polymer layers 71 and 72 and the resulting thickness of barrier 40 may occur as a result of the stretching that occurs during this stage of the thermoforming process.

In order to provide a second means for drawing polymer layers 71 and 72 into contact with the various contours of mold 60, the area between polymer layers 71 and 72 and proximal tensile member 50 may be pressurized. During a preparatory stage of this method, an injection needle may be located between polymer layers 71 and 72, and the injection needle may be located such that ridges 64 envelop the injection needle when mold 60 closes. A gas may then be ejected from the injection needle such that polymer layers 71 and 72 engage ridges 64, thereby forming an inflation conduit 73 (see FIG. 15) between polymer layers 71 and 72. The gas may then pass through inflation conduit 73, thereby entering and pressurizing the area proximal to stacked tensile member 50 and between polymer layers 71 and 72. In combination with the vacuum, the internal pressure ensures that polymer layers 71 and 72 contact the various surfaces of mold 60.

Figure 14C:
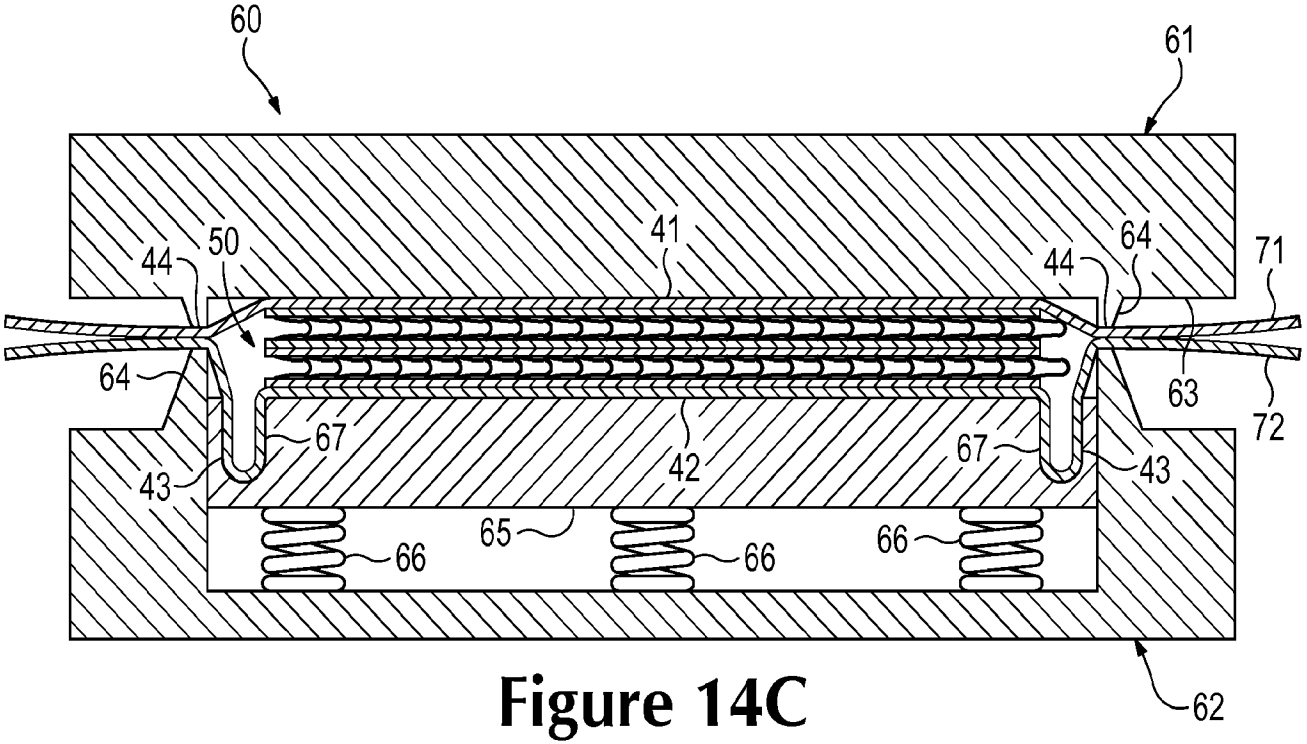

As mold 60 closes further, ridges 64 bond upper polymer layer 71 to lower polymer layer 72, as depicted in FIG. 14C, thereby forming peripheral bond 44. In addition, a movable insert 65 that is supported by various springs 66 may depress to place a specific degree of pressure upon the components, thereby bonding polymer layers 71 and 72 to opposite surfaces of stacked tensile member 50. As discussed above, a supplemental layer or thermoplastic threads may be incorporated into the surfaces of stacked tensile member 50 in order to facilitate bonding between stacked tensile member 50 and barrier 40. The pressure exerted upon the components by insert 65 ensures that the supplemental layer or thermoplastic threads form a bond with polymer layers 71 and 72. Furthermore, portions of ridge 64 that extend away from tensile member 50 form a bond between other areas of polymer layers 71 and 72 to form inflation conduit 73. As an additional matter, insert 65 includes a peripheral indentation 67 that forms sidewall barrier portion 43 from lower polymer layer 72.

Figure 15:
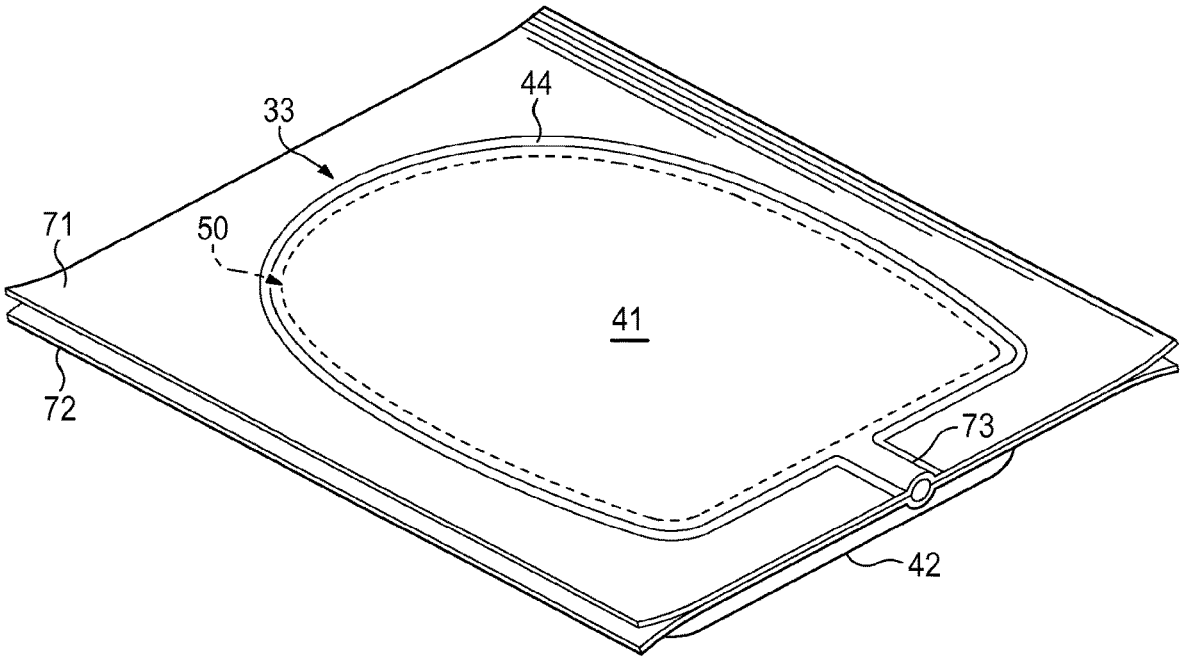
FIG. 15 is a perspective view of the first chamber and residual portions of polymer sheets forming the chamber following a portion of the manufacturing process.
Figure 16:
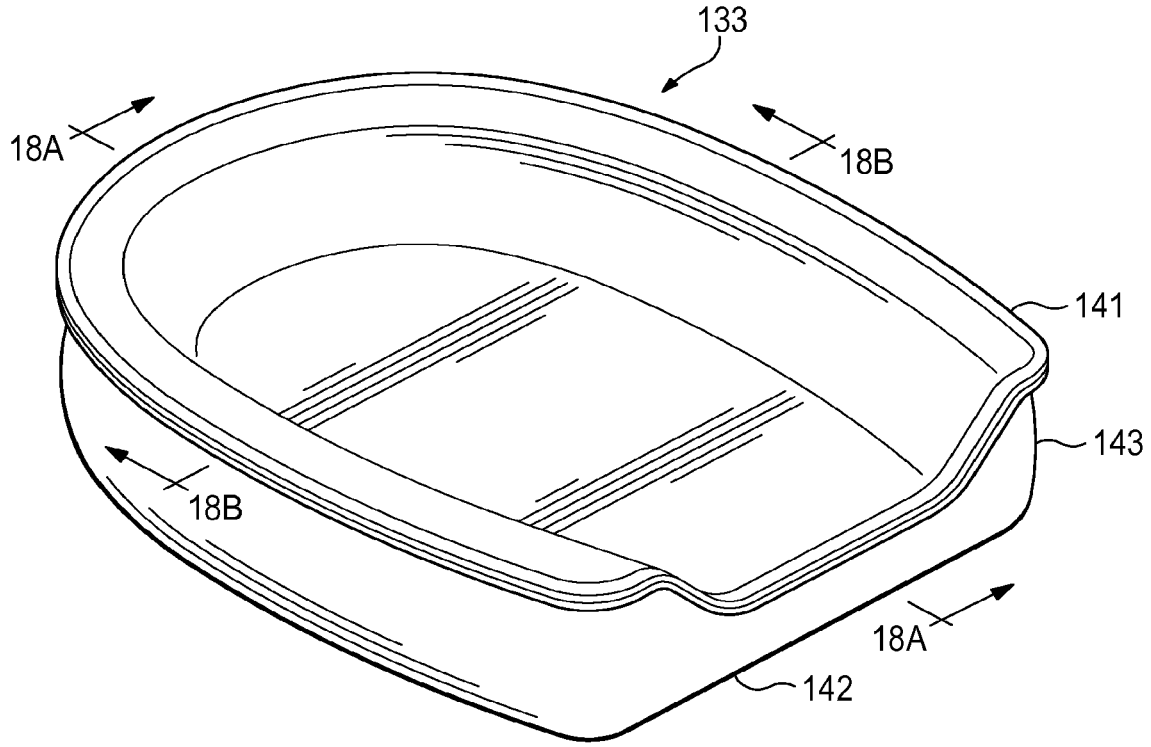
FIG. 16 is a perspective view of a second chamber.
Figure 17:
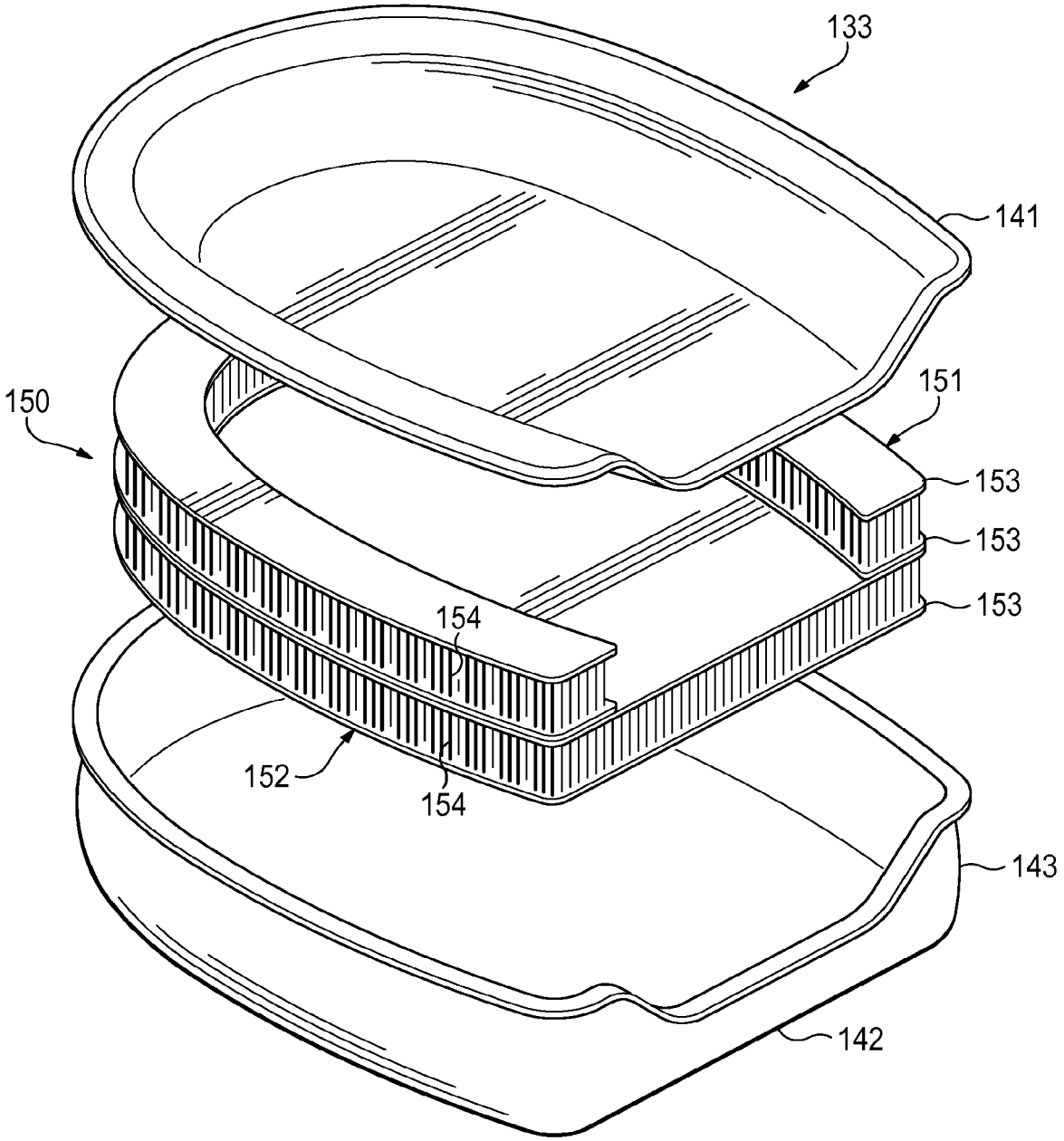
FIG. 17 is an exploded perspective view of the second chamber.

When bonding is complete, mold 60 is opened and chamber 33 and excess portions of polymer layers 71 and 72 are removed and permitted to cool, as depicted in FIG. 15. A fluid may be injected into chamber 33 through the inflation needle and inflation conduit 73. Upon exiting mold 60, stacked tensile member 50 remains in the compressed configuration. When chamber 33 is pressurized, however, the fluid places an outward force upon barrier 40, which tends to separate barrier portions 41 and 42, thereby placing stacked tensile member 50 in tension. In addition, a sealing process is utilized to seal inflation conduit 73 adjacent to chamber 33 after pressurization. The excess portions of polymer layers 71 and 72 are then removed, thereby completing the manufacture of chamber 33. As an alternative, the order of inflation and removal of excess material may be reversed. As a final step in the process, chamber 33 may be tested and then incorporated into midsole 31 of footwear 10.

Further Configurations

A chamber 133 is depicted in FIGS. 16-18B and includes a barrier 140 and a stacked tensile member 150. Barrier 140 forms an exterior of chamber 133 and (a) defines an interior void that receives both a pressurized fluid and stacked tensile member 150 and (b) provides a durable sealed barrier for retaining the pressurized fluid within chamber 133. The polymer material of barrier 140 includes an upper barrier portion 141, an opposite lower barrier portion 142, and a sidewall barrier portion 143 that extends around a periphery of chamber 133 and between barrier portions 141 and 142. Stacked tensile member 150 is located within the interior void and includes an upper tensile element 151 and a lower tensile element 152 with an overlapping configuration.

Each of tensile elements 151 and 152 are spacer textiles that include a pair of textile layers 153 a plurality of connecting members 154 extending between textile layers 153. That is, upper tensile element 151 includes two textile layers 153 with connecting members 154 extending therebetween, and lower tensile element 152 includes two more textile layers 153 with additional connecting members 154 extending therebetween. Whereas upper tensile element 151 is secured to an inner surface of upper barrier portion 141, lower tensile element 152 is secured to (a) the inner surface of upper barrier portion 141 and (b) an inner surface of lower barrier portion 142. More particularly, (a) one of textile layers 153 from upper tensile element 151 is secured to the inner surface of upper barrier portion 141, (b) one of textile layers 153 from lower tensile element 152 is secured to the inner surface of upper barrier portion 141, and (c) the other textile layer 153 from lower tensile element 152 is secured to the inner surface of lower barrier portion 142. Additionally, the centrally-located textile layers 153 from each of tensile members 151 and 152 are secured to each other, thereby joining tensile elements 151 and 152.

Based upon the above discussion, upper textile element 151 is secured to upper barrier portion 141, whereas lower textile element 152 is secured to both barrier portions 141 and 142. In order to impart this configuration, upper textile element 151 has lesser area than lower textile element 152. More particularly, upper textile element 151 is absent from a central area of chamber 133, whereas lower textile element 152 extends across both the central area and peripheral area of chamber 133. That is, upper textile element 151 has a U-shaped configuration that exposes central areas of lower textile element 152 and permits the central areas of lower textile element 152 to bond with upper barrier portion 141. Chamber 133 has a configuration wherein tensile elements 151 and 152 have different areas, which allows exposed areas to bond with both barrier portions 141 and 142 and imparts a contoured aspect to chamber 133. More particularly, this configuration forms a concave area in upper barrier portion 141, and may also form a concave area in lower barrier portion 142.

Chamber 33 exhibits a configuration wherein opposite surfaces have substantially planar configurations, at least in areas spaced inward from sidewall barrier portion 43. When incorporated into footwear 10, an upper surface of chamber 33, which is oriented to face upper 20, and a lower surface of chamber 33, which is oriented to face outsole 32, both exhibit the substantially planar configuration. As a result, the foot effectively rests upon a planar surface of chamber 33. FIGS. 16-18B depict a chamber 133 with a concave surface. That is, an upper surface of chamber 133, which may be oriented to face upper 20 when incorporated into footwear 10, has a concave configuration, and a lower surface of chamber 133, which is oriented to face outsole 32 when incorporated into footwear 10, exhibits substantially planar configuration, at least in areas spaced inward from a sidewall. Chamber 133 has a configuration, therefore, wherein the heel of the foot may rest within the concave area.

The manufacturing process for chamber 133 may be substantially similar to the manufacturing process for chamber 33 and may use mold 60. More particularly, the manufacturing process may involve (a) placing two polymer layers between mold portions 61 and 62, (b) locating tensile elements 151 and 152 between the polymer layers, (c) and compressing the components within mold 60 to bond the elements together. In contrast with the method discussed above for chamber 33, a method for manufacturing chamber 133 may also include bonding lower tensile element 152 to upper barrier portion 141. That is, the different sizes for tensile elements 151 and 152 will impart a configuration wherein lower tensile element 152 is also bonded to upper barrier portion 141.

Figure 19A:
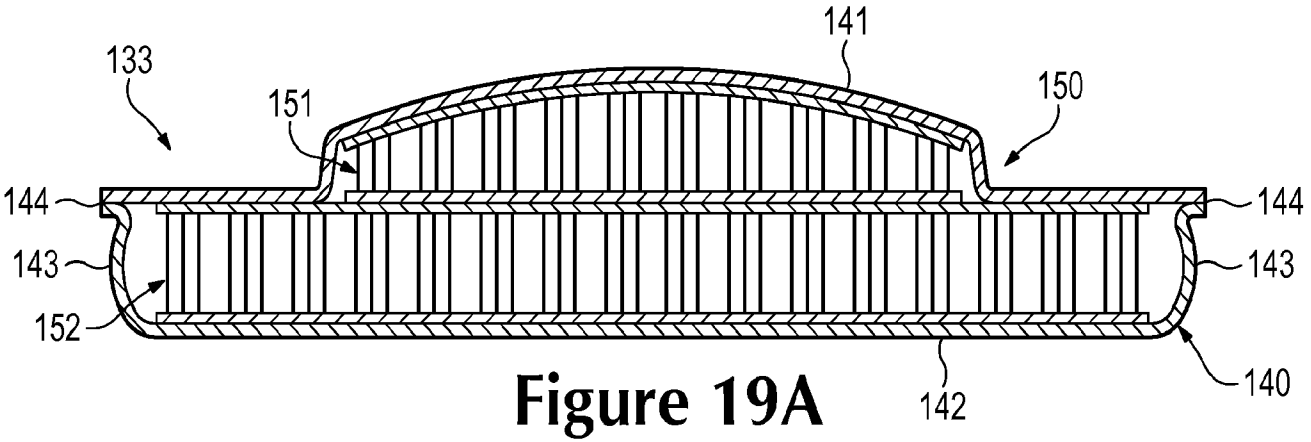
FIGS. 19A-19D are cross-sectional views corresponding with FIG. 18A and depicting further configurations of the second chamber.
Figure 19B:
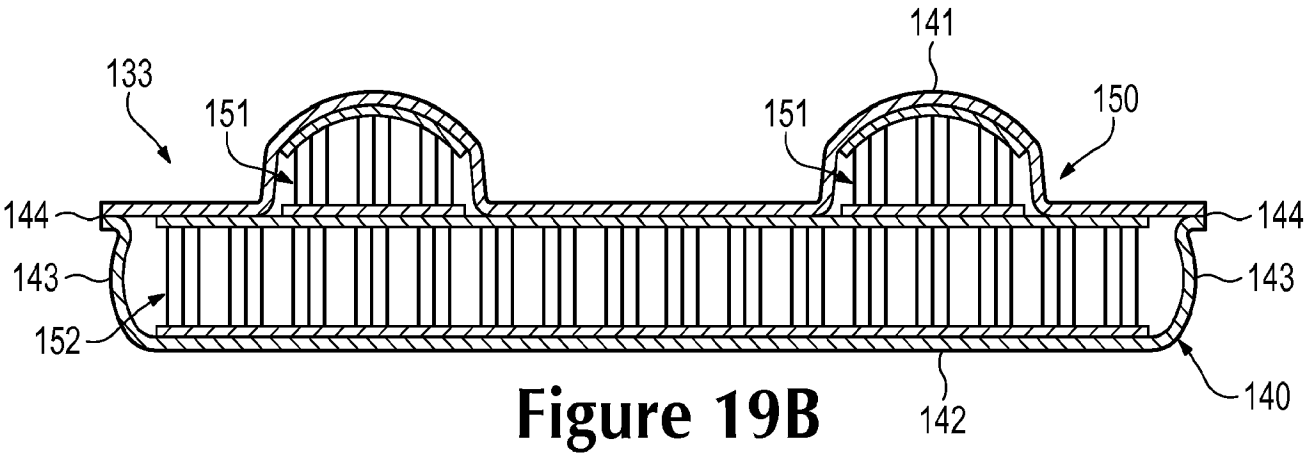
Figure 19C:
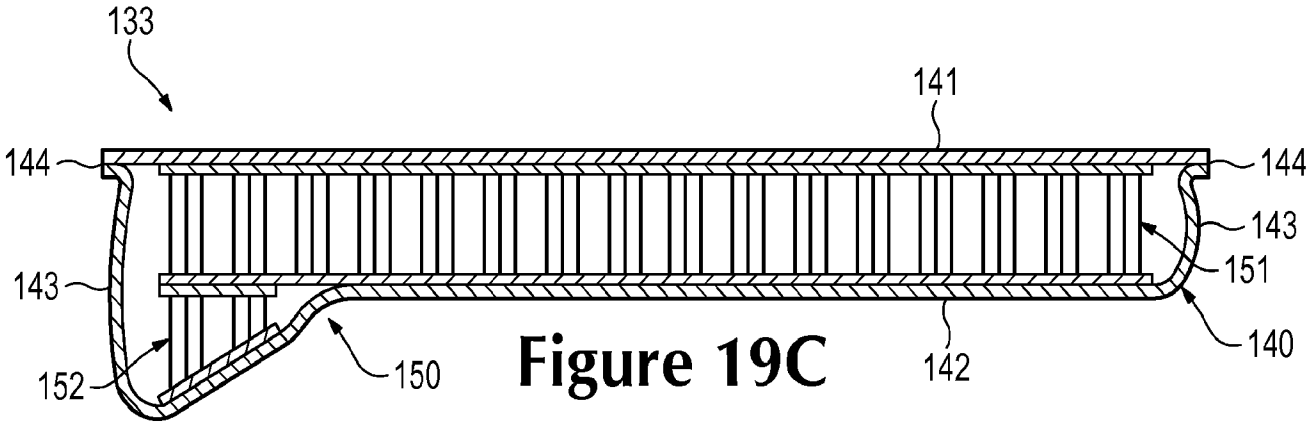

Forming tensile elements 151 and 152 to have different areas or shapes may be utilized to impart a variety of contours to chamber 133 or other chambers. In further configurations, upper tensile element 151 may be located in the central area of chamber 133 and absent from the peripheral area of chamber 133 to impart a rounded or convex configuration to the upper surface, as depicted in FIG. 19A. Upper tensile element 151 may also be spaced inward from sides of lower tensile element 152 and also absent from the central area, as depicted in FIG. 19B. As another example, upper tensile element 151 may have greater area than lower tensile element 152 to impart a contour to the lower surface of chamber 133, as depicted in FIG. 19C.

Figure 18A:
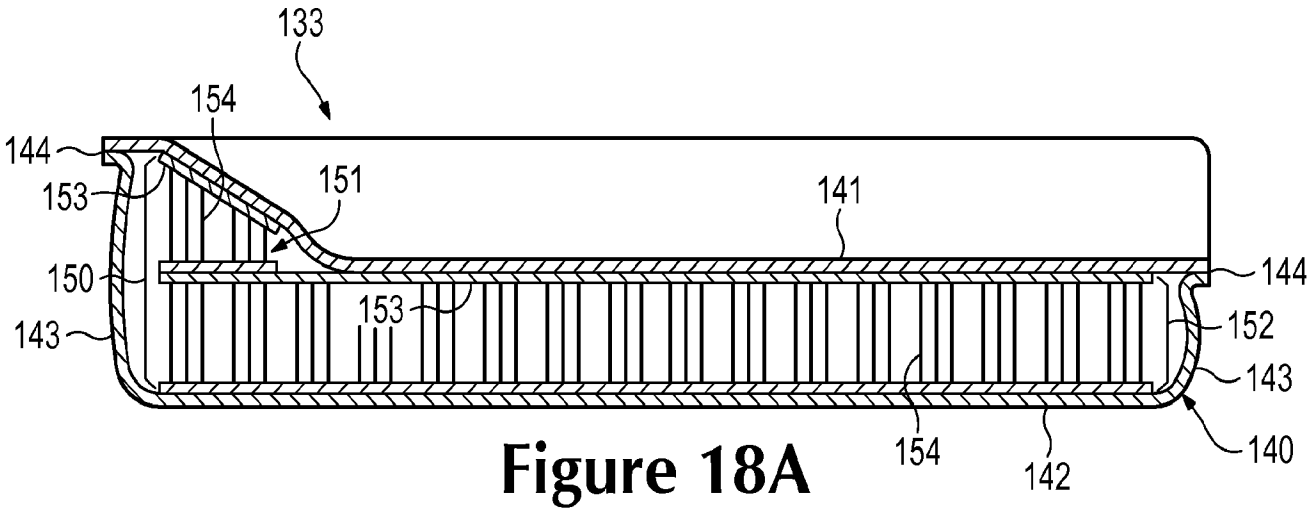
FIGS. 18A and 18B are cross-sectional views of the second chamber, as defined by section lines 18A and 18B in FIG. 16.
Figure 18B:
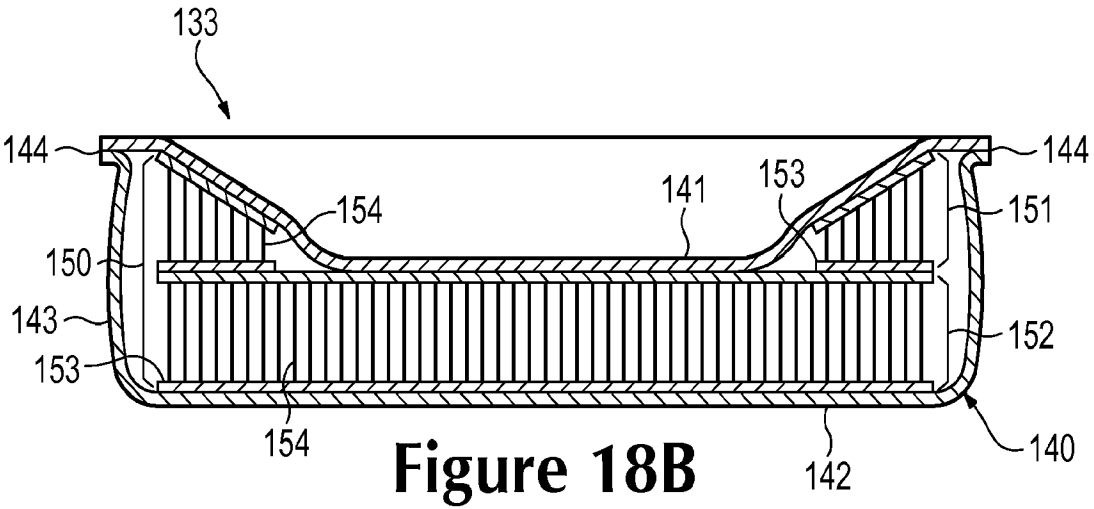
Figure 19D:
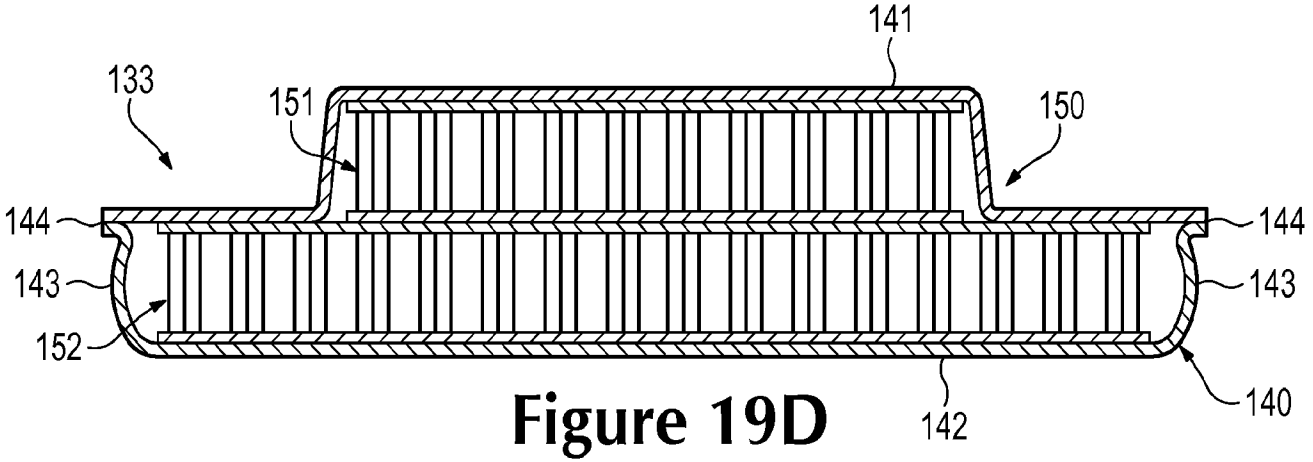

Forming chambers 133 with tensile elements 151 and 152 having different areas may induce edges of upper tensile element 151 to taper or curve toward lower tensile element 152. Referring to FIGS. 18A and 18B, for example, upper tensile element 151 appears to have a tapered configuration. Similarly, referring to FIG. 19A, upper tensile element 151 appears to have a curved configuration. During manufacturing, upper barrier portion 141 is secured to lower tensile element 152 in a location that is adjacent to the edge of upper tensile element 151. Upon inflation, the securing of upper barrier portion 141 to lower tensile element 152 inhibits upper tensile element 151 from expanding fully, thereby imparting the tapered or curved configuration. Other molding processes, however, may form upper barrier portion 141 in a manner that allows upper tensile element 151 to expand fully, as depicted in FIG. 19D. That is, stretching or forming the polymer material of upper barrier portion in an area that is adjacent to the edge of upper tensile element 151 may permit upper tensile element 151 to expand fully upon inflation of chamber 133.

Based upon the above discussion, chambers with various configurations may incorporate stacked tensile members. When tensile elements within the stacked tensile members have substantially equal areas, upper and lower surfaces of the chambers may exhibit planar and parallel surfaces. By varying the areas between the tensile elements, however, various contours or other features may be imparted to the chambers.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. Footwear comprising an upper, an outsole, and a fluid-filled chamber secured to the outsole, wherein the fluid-filled chamber comprises:

a barrier formed from a first polymer layer and a second polymer layer, the first polymer layer being joined to the second polymer layer to define an interior void;

a tensile member located within the interior void, the tensile member including a first tensile element and a second tensile element, the first tensile element having a pair of spaced textile layers joined by a plurality of connecting members, and the second tensile element being joined to one of the textile layers of the first tensile element, an outward facing surface of the first tensile element being joined to the first polymer layer, and an outward facing surface of the second tensile element being joined to the second polymer layer; and a fluid located within the interior void, the fluid being pressurized to place an outward force upon the barrier and induce tension in the tensile member;

wherein sidewalls of the chamber are at least partially exposed.

2. The footwear recited in claim 1, wherein the second tensile element is one of a spacer textile and a polymer foam material.

3. The footwear recited in claim 1, wherein at least one surface of the chamber has a concave configuration.

4. The footwear recited in claim 1, wherein the first tensile element has a first thickness, the second tensile element has a second thickness, and the first thickness is less than the second thickness.

5. The footwear recited in claim 1, wherein the first tensile element has a first area, the second tensile element has a second area, and the first area is less than the second area.

6. The footwear recited in claim 1, wherein the second tensile element is a polymer foam material.

7. The footwear recited in claim 1, wherein the first tensile element has a U-shaped configuration.

8. The footwear recited in claim 7, wherein the second tensile element comprises an inward facing surface opposite the outward facing surface of the second tensile element, wherein the first tensile element exposes a central area of the inward facing surface, and wherein the exposed central area is bonded to the first polymer layer.

9. The footwear recited in claim 1, wherein the plurality of connecting members of the first tensile element are arranged in a first set of rows, the second tensile element comprises a second pair of spaced textile layers joined by a second plurality of connecting members arranged in a second set of rows, and the rows of the first set are not aligned with the rows of the second set.

10. The footwear of claim 1, wherein the first tensile element is tapered and imparts a tapered configuration to the chamber.

11. The footwear of claim 1, wherein the second tensile element comprises an inward facing surface opposite the outward facing surface of the second tensile element, wherein the first tensile element is located in a central area of the inward facing surface, and wherein the first tensile element is absent from a peripheral area of the inward facing surface.

12. The footwear of claim 1, wherein the first tensile element imparts a convex configuration to a surface of the chamber formed by the first polymer layer.

13. The footwear of claim 1, wherein the second tensile element comprises an inward facing surface opposite the outward facing surface of the second tensile element, wherein the first tensile element is located on the inward facing surface, wherein the first tensile element is displaced from sides of the inward facing surface, and wherein the first tensile element is absent from a central area of the inward facing surface.

14. The footwear of claim 1 further comprising a midsole and the midsole extends over the chamber between the chamber and the upper.

15. The footwear of claim 14 wherein the midsole further extends under the chamber and between the chamber and the outsole.

16. The footwear of claim 14 wherein the chamber is incorporated in a heel region of the midsole.

17. The chamber of claim 14, wherein the chamber is incorporated in a heel region of the midsole and extending into a forefoot region.

18. The footwear of claim 1 wherein the chamber is secured to the upper and the outsole.

19. The footwear recited in claim 1, wherein the plurality of connecting members of the first tensile element are arranged in a first set of rows, the second tensile element comprises a second pair of spaced textile layers joined by a second plurality of connecting members arranged in a second set of rows, and the rows of the first set are aligned with the rows of the second set.

20. The footwear recited in claim 1, wherein the first tensile element has a first thickness, the second tensile element has a second thickness, and the first thickness is the same as the second thickness.

* * * * *